US012215454B2

(12) United States Patent
Park et al.

(10) Patent No.: US 12,215,454 B2
(45) Date of Patent: Feb. 4, 2025

(54) WASHER AND CONTROL METHOD THEREOF

(71) Applicant: SAMSUNG ELECTRONICS CO., LTD., Suwon-si (KR)

(72) Inventors: Junhyun Park, Suwon-si (KR); Kanghyun Kim, Suwon-si (KR); Seunghun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 206 days.

(21) Appl. No.: 17/728,431

(22) Filed: Apr. 25, 2022

(65) Prior Publication Data

US 2022/0372687 A1 Nov. 24, 2022

Related U.S. Application Data

(63) Continuation of application No. PCT/KR2022/003770, filed on Mar. 17, 2022.

(30) Foreign Application Priority Data

May 21, 2021 (KR) ..... 10-2021-0065464

(51) Int. Cl.

| | |
|---|---|
| ***D06F 37/30*** | (2020.01) |
| ***D06F 34/18*** | (2020.01) |
| *D06F 103/04* | (2020.01) |
| *D06F 105/48* | (2020.01) |

(52) U.S. Cl.

CPC ..... *D06F 37/304* (2013.01); *D06F 34/18* (2020.02); *D06F 2103/04* (2020.02); *D06F 2105/48* (2020.02)

(58) Field of Classification Search

CPC ..... D06F 37/304

See application file for complete search history.

(56) References Cited

U.S. PATENT DOCUMENTS

| | | | |
|---|---|---|---|
| 5,161,393 | A | 11/1992 | Payne et al. |
| 9,890,489 | B2 | 2/2018 | Janke et al. |
| 9,988,753 | B2 | 6/2018 | Janke et al. |
| 10,214,847 | B2 | 2/2019 | Nakamoto |
| 10,584,436 | B2 | 3/2020 | Lee et al. |

(Continued)

FOREIGN PATENT DOCUMENTS

| | | |
|---|---|---|
| EP | 2 221 412 A1 | 8/2010 |
| EP | 3 887 589 B1 | 6/2023 |

(Continued)

OTHER PUBLICATIONS

International Search Report for PCT Application No. PCT/KR2022/003770 dated Jul. 11, 2022.

(Continued)

*Primary Examiner* — Jason Y Ko

(74) *Attorney, Agent, or Firm* — STAAS & HALSEY LLP

(57) ABSTRACT

A washer includes a drum, a motor connected to the drum, a motor drive connected to the motor and configured to supply a driving current to the motor to rotate the drum, and a processor connected to the motor drive. The processor is configured to control the motor drive to supply the driving current to the motor to rotate the motor at a target speed and to determine a magnitude of a load accommodated in the drum while controlling a rotational speed of the motor within a predetermined range.

20 Claims, 18 Drawing Sheets

(56) References Cited

U.S. PATENT DOCUMENTS

| | | | |
|---|---|---|---|
| 2005/0015890 | A1 | 1/2005 | Kim et al. |
| 2009/0106913 | A1 | 4/2009 | Suel, II et al. |
| 2014/0101865 | A1 | 4/2014 | Jang et al. |

FOREIGN PATENT DOCUMENTS

| | | | |
|---|---|---|---|
| JP | 11-70289 | | 3/1999 |
| JP | 2009-189537 | | 8/2009 |
| JP | 2011-104141 | | 6/2011 |
| JP | 2018-110711 | A | 7/2018 |
| KR | 10-0436152 | B1 | 6/2004 |
| KR | 10-0701949 | B1 | 3/2007 |
| KR | 10-1885178 | | 8/2018 |
| KR | 2020-156905 | | 10/2020 |
| KR | 10-2021-0044496 | A | 4/2021 |
| KR | 10-2305844 | | 9/2021 |

OTHER PUBLICATIONS

European Search Report dated Jun. 24, 2004 issued in EP Application No. EP 22 80 4819.

WASHER AND CONTROL METHOD THEREOF

CROSS-REFERENCE TO RELATED APPLICATION(S)

This application is a continuation application, under 35 U.S.C. § 111(a), of international application No. PCT/KR2022/003770, filed on Mar. 17, 2022, which claims priority to Korean Patent Application No. 10-2021-0065464, filed on May 21, 2021, in the Korean Intellectual Property Office, the disclosure of which is incorporated by reference herein in its entirety.

BACKGROUND

1. Field

The disclosure relates to a washer and a control method thereof, more particularly to, a washer configured to measure a load, and a control method thereof.

2. Description of Related Art

In general, a washer may include a tub accommodating water for washing and a drum rotatably installed in the tub. In addition, the washer may wash laundry by rotating the drum containing the laundry.

The washer may perform a washing cycle for washing laundry, a rinsing cycle for rinsing the washed laundry, and a spin-drying cycle for spin-drying the laundry. The washer may measure a weight-side load of the laundry accommodated in the drum to determine an amount of water to be supplied to the tub during the washing and rinsing cycles.

A conventional washer provides a constant torque to a drum, and measures a load based on a change in a rotational speed of the drum in response to the constant torque. However, due to a large change in the rotational speed of the drum while measuring the load, it is difficult to accurately measure the load. In addition, in order to prevent inaccuracy in measuring the load caused by the change in the rotational speed of the drum, the washer measures the load in a low rotational speed section of the drum.

SUMMARY

Therefore, it is an aspect of the disclosure to provide a washer capable of measuring a weight (i.e., load) of laundry accommodated in a drum while minimizing a change in a rotational speed of the drum and a control method thereof.

It is another aspect of the disclosure to provide a washer capable of measuring a weight (i.e., load) of laundry accommodated in a drum even at a high-speed rotation, and a control method thereof.

Additional aspects of the disclosure will be set forth in part in the description which follows and, in part, will be obvious from the description, or may be learned by practice of the disclosure.

In accordance with an aspect of the disclosure, a washer includes a drum, a motor connected to the drum, a motor drive connected to the motor and configured to supply a driving current to the motor to rotate the drum, and a processor connected to the motor drive. The processor is configured to control the motor drive to supply the driving current to the motor to rotate the motor at a target speed and to determine a magnitude of a load accommodated in the drum while controlling a rotational speed of the motor within a predetermined range.

The processor may be further configured to periodically control the rotational speed of the motor within 5% of the target speed.

The processor may be further configured to periodically control within 0.5% of the rotational speed of the motor during spin-drying.

The processor may be further configured to control the motor drive to supply the driving current comprising a sinusoidal current to the motor, and determine the magnitude of the load accommodated in the drum based on a change in the rotational speed of the motor caused by the driving current comprising the sinusoidal current.

The processor may be further configured to provide a target speed signal comprising a sinusoidal waveform to the motor drive so as to supply the driving current comprising the sinusoidal current to the motor.

The processor may be further configured to control the motor drive to control the rotational speed of the motor based on the magnitude of the load.

The processor may be further configured to control the motor drive to supply a first driving current comprising the sinusoidal current to the motor before supplying water to the drum, and adjust an amount of water supplied to the drum based on a value of a first rotational speed of the motor caused by the first driving current.

The processor may be further configured to control the motor drive to supply a second drive current comprising the sinusoidal current to the motor after supplying water to the drum, control the motor drive to control the rotational speed of the motor based on a value of a second rotational speed of the motor caused by the second driving current, and determine a magnitude of a load accommodated in the drum based on a ratio of the value of the first rotational speed to the value of the second rotational speed.

The processor may be further configured to identify a magnitude of a dry load accommodated in the drum based on a change in the first rotational speed of the motor, and identify a magnitude of a wet load accommodated in the drum based on a change in the second rotational speed of the motor.

The processor may be further configured to control the motor drive to control the rotational speed of the motor based on a ratio of the magnitude of the wet load to the magnitude of the dry load.

The processor may be further configured to control the motor drive to rotate the motor at a first speed based on the ratio of the magnitude of the wet load to the magnitude of the dry load being less than a first reference value, and control the motor drive to rotate the motor at a second speed, which is less than the first speed, based on the ratio of the magnitude of the wet load to the magnitude of the dry load being equal to or greater than the first reference value.

The processor may be further configured to control the motor drive to supply a third drive current comprising the sinusoidal current to the motor during rotating the motor at a third speed for a spin-drying operation of the washer, and identify a magnitude of a spin-dried load of the drum based on a value of a third rotational speed of the motor comprising a sinusoidal waveform caused by the third driving current.

The processor may be further configured to control the motor drive to control the rotational speed of the motor based on the magnitude of the spin-dried load.

The processor may be further configured to control the motor drive to reduce the rotational speed of the motor based on a ratio of the magnitude of the spin-dried load to the magnitude of the dry load being less than a second reference value, and control the motor drive to maintain the rotational speed of the motor based on the ratio of the magnitude of the spin-dried load to the magnitude of the dry load being equal to or greater than the second reference value.

In accordance with another aspect of the disclosure, a control method of a washer includes controlling, by a processor, a motor drive to supply a driving current to a motor, rotating a drum connected to the motor at a target speed, controlling a rotational speed of the motor within a predetermined range, determining a magnitude of a load accommodated in the drum in response to the controlling of the rotational speed of the motor within the predetermined range, and controlling the rotational speed of the motor based on the magnitude of the load.

The control method may further comprises controlling the motor drive to supply the driving current comprising a sinusoidal current to the motor, and determining the magnitude of the load accommodated in the drum based on a change in the rotational speed of the motor caused by the driving current comprising the sinusoidal current.

The controlling of the motor drive to supply the driving current may further comprises transmitting a target speed signal comprising a sinusoidal waveform to the motor drive.

The control method may further comprises controlling the motor drive to control the rotational speed of the motor based on the magnitude of the load.

The control method may further comprises controlling the motor drive to supply a first driving current comprising the sinusoidal current to the motor before supplying water to the drum, and adjusting an amount of water supplied to the drum based on a value of a first rotational speed of the motor caused by the first driving current.

The control method may further comprises controlling the motor drive to supply a second drive current comprising the sinusoidal current to the motor after supplying water to the drum, controlling the motor drive to control the rotational speed of the motor based on a value of a second rotational speed of the motor caused by the second driving current, and determining a magnitude of a load accommodated in the drum based on a ratio of the value of the first rotational speed to the value of the second rotational speed.

In accordance with another aspect of the disclosure, a washer includes a drum, a motor connected to the drum through a rotating shaft, a motor drive operatively connected to the motor, and a processor operatively connected to the motor drive. The processor is configured to control the motor drive to supply a driving current including a sinusoidal current to the motor, and to determine a magnitude of a load accommodated in the drum based on a change in the rotational speed of the motor caused by the driving current including the sinusoidal current.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
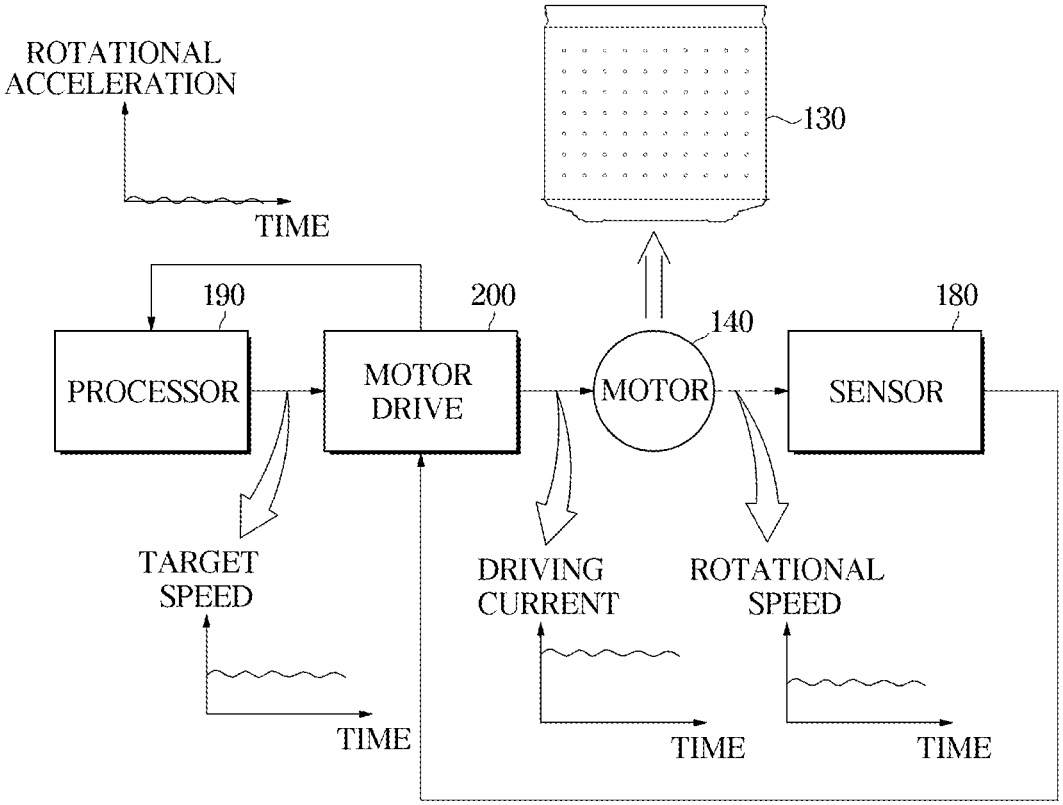
FIG. 1 schematically illustrates a washer according to an embodiment of the disclosure.

In the following description, like reference numerals refer to like elements throughout the specification. Well-known functions or constructions are not described in detail since they would obscure the one or more exemplar embodiments with unnecessary detail. Terms such as "unit", "module", "member", and "block" may be embodied as hardware or software. According to embodiments, a plurality of "unit", "module", "member", and "block" may be implemented as a single component or a single "unit", "module", "member", and "block" may include a plurality of components.

It will be understood that when an element is referred to as being "connected" another element, it can be directly or indirectly connected to the other element, wherein the indirect connection includes "connection via a wireless communication network".

Also, when a part "includes" or "comprises" an element, unless there is a particular description contrary thereto, the part may further include other elements, not excluding the other elements.

Throughout the description, when a member is "on" another member, this includes not only when the member is in contact with the other member, but also when there is another member between the two members.

It will be understood that, although the terms first, second, third, etc., may be used herein to describe various elements, but is should not be limited by these terms. These terms are only used to distinguish one element from another element.

As used herein, the singular forms "a," "an" and "the" are intended to include the plural forms as well, unless the context clearly indicates otherwise.

An identification code is used for the convenience of the description but is not intended to illustrate the order of each step. The each step may be implemented in the order different from the illustrated order unless the context clearly indicates otherwise.

Reference will now be made in detail to embodiments of the disclosure, examples of which are illustrated in the accompanying drawings.

FIG. 1 schematically illustrates a washer according to an embodiment of the disclosure.

Referring to FIG. 1, a washer 100 may include a drum 130, a processor 190, a motor drive 200, a motor 140, and a sensor 180.

The drum 130 may accommodate laundry for washing. The drum 130 may be rotated by the motor 140.

During the drum 130 is rotated, the laundry accommodated in the drum 130 may be washed. For example, during the drum 130 is rotated, the laundry may fall from top to bottom, and the laundry may be washed by mechanical impact (or friction) caused by the fall. As another example, during the drum 130 is rotated, the laundry may collide with water accommodated in the drum 130, and the laundry may be washed by mechanical impact (or friction) caused by the collision.

In addition, water may be separated from the laundry by the rotation of the drum 130. In other words, the laundry may be spin-dried by the rotation of the drum 130. For example, during the drum 130 is rotated, water may be separated from the laundry by the centrifugal force, and the separated water may be discharged to an outside of the washer 100.

The processor 190 may provide an electrical signal (hereinafter, referred to as a "target speed command") corresponding to a target speed for rotating the drum 130, to a motor drive 200. For example, the processor 190 may store a rotational speed (angular velocity) of the drum 130 for washing, a rotational speed of the drum 130 for rinsing, and a rotational speed of the drum 130 for spin-drying. The processor 190 may provide the motor drive 200 with a target speed corresponding to a progress of a washing operation (washing, rinsing, or spin-drying).

In addition, the processor 190 may provide the motor drive 200 with a target speed command for measuring a weight (i.e., load) of the laundry accommodated in the drum 130.

The target speed for measuring the load may vary over time. For example, as illustrated in FIG. 1, the target speed may be provided as a sum of a first target speed having a predetermined magnitude that does not change over time and a second target speed in the form of a sinusoidal wave that changes over time. In other words, the target speed for measuring the load may be in the form of a sinusoidal wave in which a magnitude of a rotational speed changes over time without a change in a rotation direction.

As mentioned above, the processor 190 may provide a target speed command, which has a waveform in which a sinusoidal wave is superimposed on a constant value, to the motor drive 200.

The motor drive 200 may receive the target speed command from the processor 190, and may provide a driving current corresponding to the target speed command to the motor 140.

The motor drive 200 may control the driving current, which is provided to the motor 140, based on a difference between the target speed and the measured speed of the motor 140. For example, the motor drive 200 may receive information about the rotation of the motor 140 from the sensor 180. The motor drive 200 may receive rotational displacement of a rotating shaft of the motor 140 from the sensor 180, and may determine a rotational speed of the rotating shaft based on the received rotational displacement. In this case, the motor drive 200 may provide information about a rotational speed of the rotating shaft to the processor 190.

The motor drive 200 may increase the driving current in response to the measured speed of the motor 140 being less than the target speed. Further, the motor drive 200 may reduce the driving current in response to the measured speed of the motor 140 being greater than the target speed.

The motor drive 200 may receive the target speed command for measuring a load from the processor 190.

The motor drive 200 may provide a driving current including a sinusoidal current to the motor 140 in response to a target speed command having a waveform in which a sinusoidal wave is superimposed on a predetermined value. Particularly, the motor drive 200 receiving the target speed command that changes over time may provide a driving current, which changes over time, to the motor 140 so as to allow the rotational speed of the motor 140 to follow the target speed command. Further, the motor drive 200 may provide an electrical signal representing a value of the driving current to the processor 190.

The motor 140 may receive the driving current from the motor drive 200 and rotate the drum 130 and the laundry (load) accommodated in the drum 130 in response to the driving current supplied from the motor drive 200.

For example, the motor 140 may include a permanent magnet that forms a magnetic field and a coil that forms a magnetic field in response to a driving current. The motor 140 may rotate the rotating shaft connected to the drum 130 using the magnetic field of the permanent magnet and a magnetic interaction between coils. In other words, the magnetic field of the permanent magnet and the magnetic interaction between the coils may provide a torque to the rotating shaft, and in response to the torque, the rotating shaft may be rotated.

In this case, the motor 140 may receive the driving current having the waveform, in which the sinusoidal wave is superimposed on the constant value, from the motor drive 200. In other words, the motor 140 may receive the driving current having the magnitude that changes over time from the motor drive 200.

Accordingly, a torque that changes over time may be applied to the rotating shaft of the motor 140. Due to the time-varying torque, the rotational speed of the rotating shaft and the drum 130 may change over time as illustrated in FIG. 1. In addition, due to the time-varying torque, the change in the rotational speed, that is, the rotational acceleration (angular acceleration) may also change over time.

In this case, the magnitude of the change in the rotational acceleration may be changed according to the weight of the laundry accommodated in the drum 130, that is the load, according to the laws of physics (Newton's first law of motion). For example, as the load increases, the magnitude of the change in the rotational acceleration may decrease, and as the load decreases, the magnitude of the change in the acceleration may increase.

The sensor 180 may detect the rotation of the rotating shaft of the motor 140 (e.g., rotational displacement, rotational speed, rotation direction, etc.), and transmit an electrical signal corresponding to the detected rotation of the rotating shaft to the processor 190 and the motor drive 200. For example, the sensor 180 may detect the rotational displacement and the rotation direction of the rotating shaft, and may provide the rotational displacement and rotation direction to the processor 190.

The processor 190 may receive a driving current value and a rotational speed value of the rotating shaft from the motor drive 200. The processor 190 may determine the rotational acceleration (angular acceleration of the rotating shaft) of the rotating shaft based on the rotational speed of the rotating shaft.

The driving current may be a waveform in which a sinusoidal wave is superimposed on a constant value. Further, the rotational speed may be in the form of a sinusoidal wave without a change in the rotation direction, and thus the rotational acceleration of the rotating shaft may be in the form of a sinusoidal wave.

The processor 190 may determine the magnitude of the load accommodated in the drum 130 based on the driving current value, in which the sinusoidal wave is superimposed, supplied to the motor 140, and the rotational acceleration of the rotating shaft in the form of a sinusoidal wave. For example, the processor 190 may determine the magnitude of the load accommodated in the drum 130 based on a ratio between an amplitude of the driving current and an amplitude of the rotational acceleration.

As described above, the processor 190 may control the motor drive 200 to supply a driving current including a sinusoidal wave to the motor 140, and the processor 190 may identify the rotational acceleration of the motor 140 by the driving current including the sinusoidal wave. The processor 190 may identify the magnitude of the load of the drum 130 connected to the rotating shaft of the motor 140 based on the driving current supplied to the motor 140 and the rotational acceleration of the motor 140.

Hereinafter a configuration and operation of the washer 100 will be described.

Figure 2:
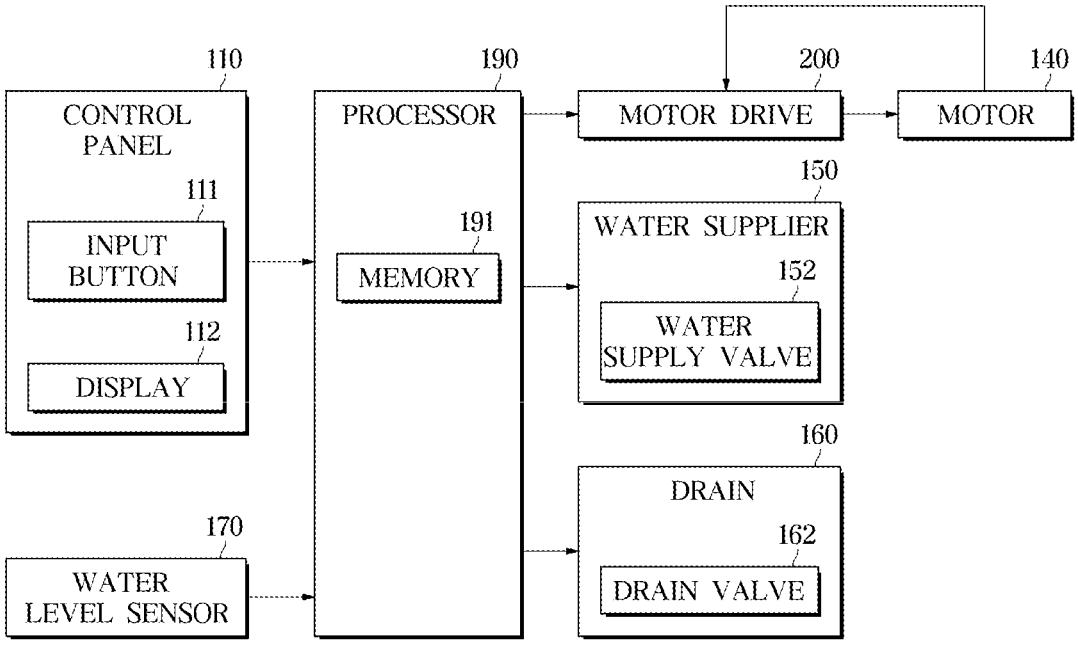
FIG. 2 illustrates a configuration of the washer according to an embodiment of the disclosure.
Figure 3:
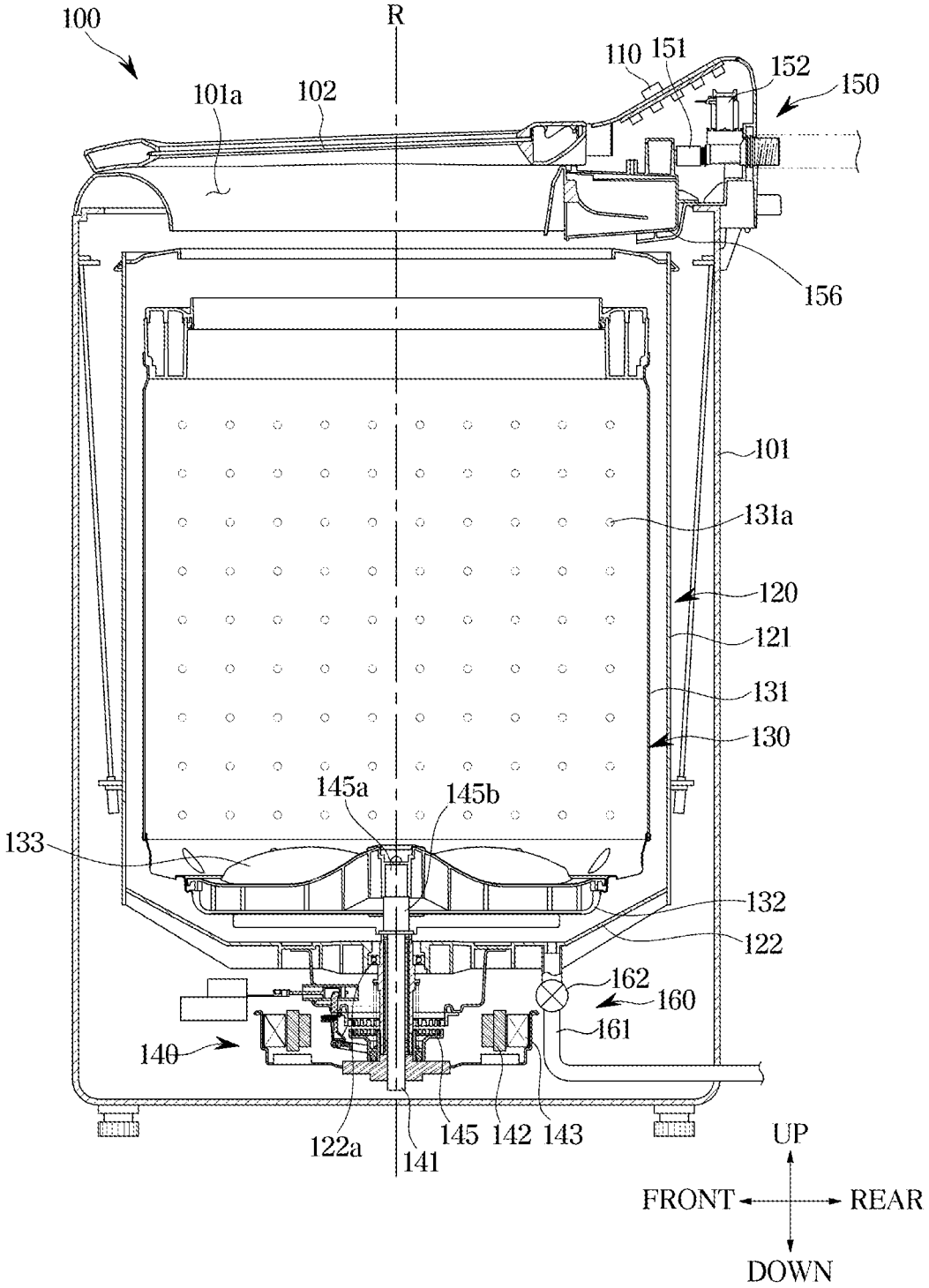
FIG. 3 illustrates an example of the washer according to an embodiment of the disclosure.
Figure 4:
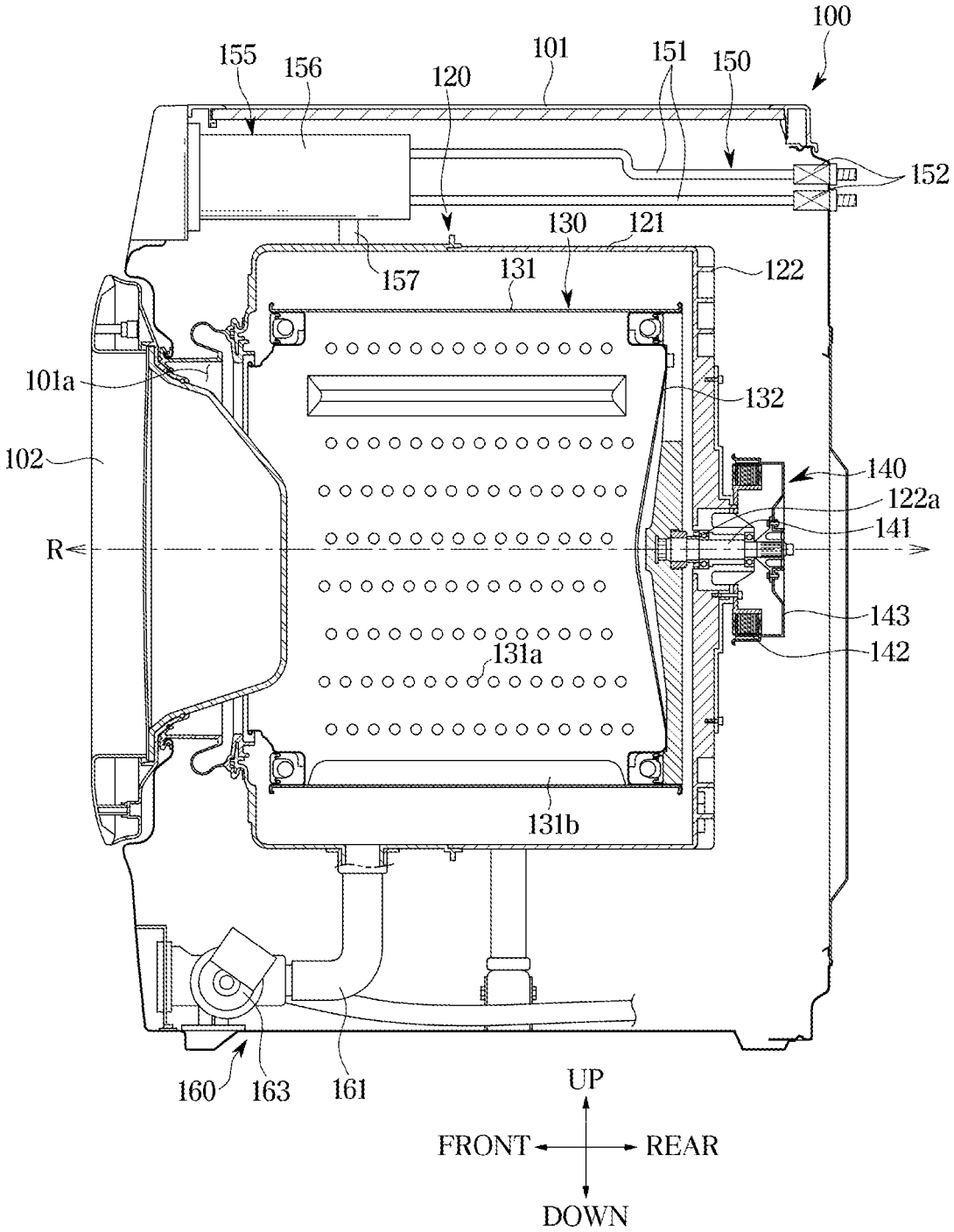
FIG. 4 illustrates another example of the washer according to an embodiment of the disclosure.
Figure 5:
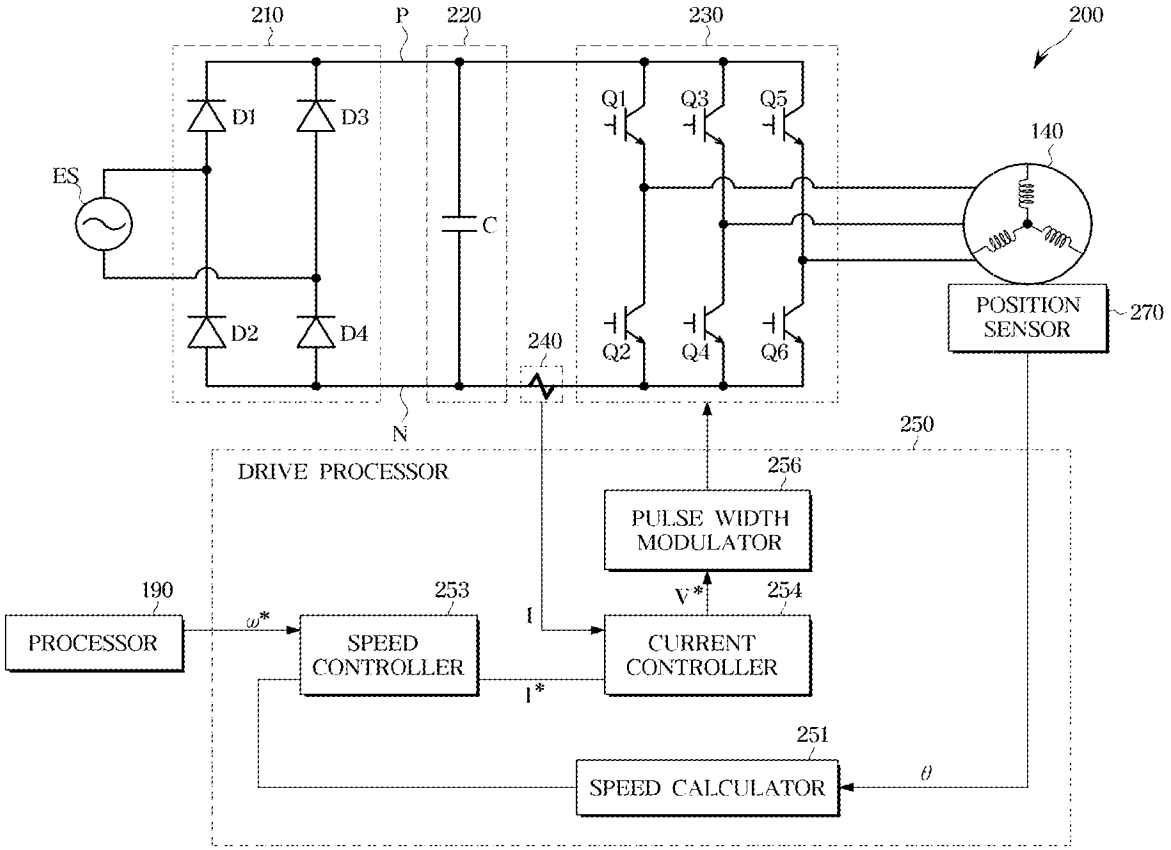
FIG. 5 illustrates an example of a motor drive included in the washer according to an embodiment of the disclosure.
Figure 6:
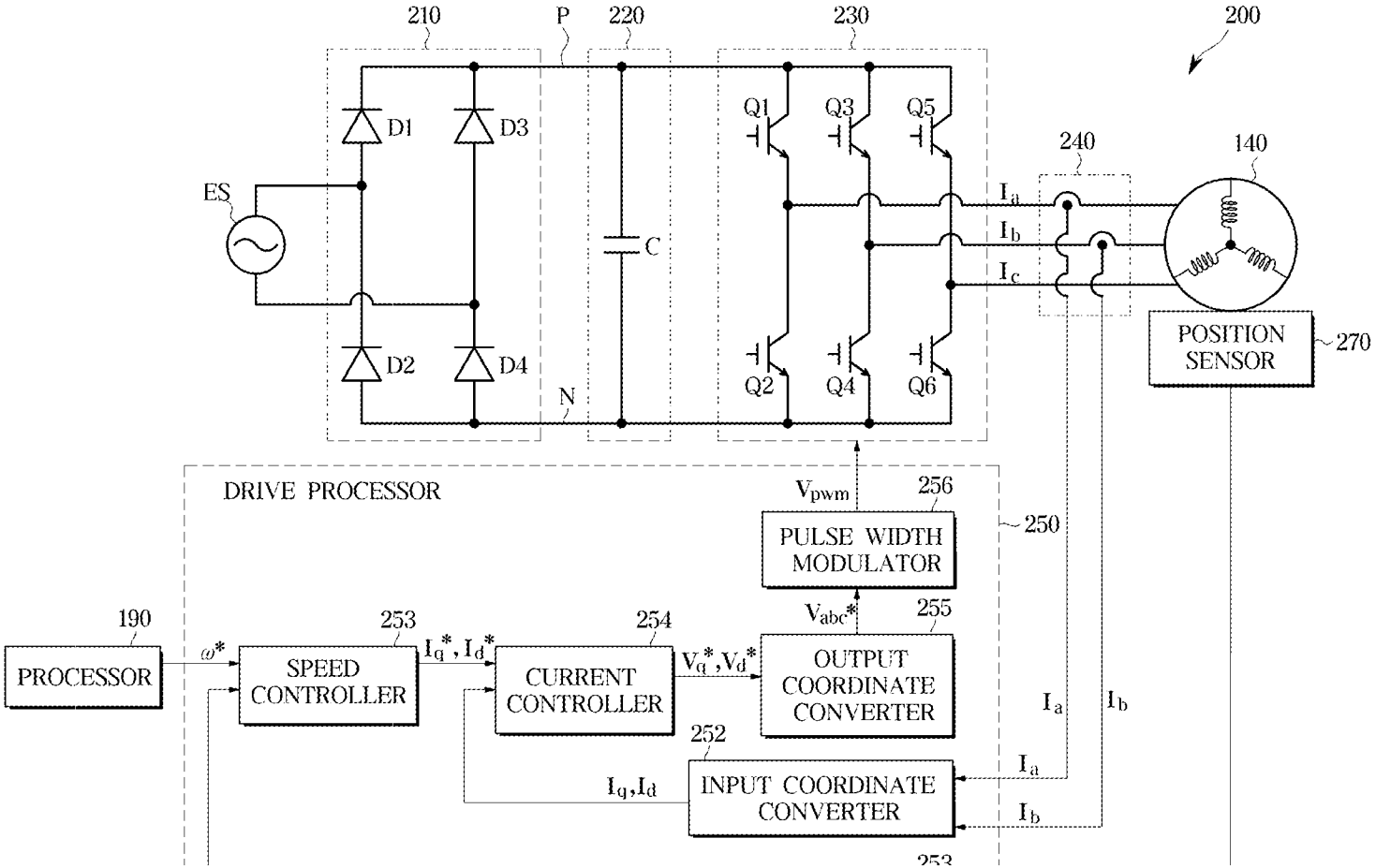
FIG. 6 illustrates another example of the motor drive included in the washer according to an embodiment of the disclosure.

FIG. 2 illustrates a configuration of the washer according to an embodiment of the disclosure. FIG. 3 illustrates an example of the washer according to an embodiment of the disclosure. FIG. 4 illustrates another example of the washer according to an embodiment of the disclosure. FIG. 5 illustrates an example of a motor drive included in the washer according to an embodiment of the disclosure. FIG. 6 illustrates another example of the motor drive included in the washer according to an embodiment of the disclosure.

Referring to FIGS. 2, 3, 4, 5 and 6, the washer 100 may include a control panel 110, a tub 120, the drum 130, the motor 140, a water supplier 150, a detergent supplier 155, a drain 160, the motor drive 200, a water level sensor 170, and the processor 190.

The washer 100 may include a cabinet 101 accommodating components included in the washer 100. The control panel 110, the water level sensor 170, the motor drive 200, the motor 140, the water supplier 150, the drain 160, the detergent supplier 155, the drum 130 and the tub 120 may be accommodated in the cabinet 101.

An inlet 101*a* for inserting or withdrawing laundry is provided on one surface of the cabinet 101.

For example, the washer 100 may include a top-loading washer in which an inlet 101*a* for inserting or withdrawing laundry is arranged on an upper surface of the cabinet 101 as illustrated in FIG. 3 or a front-loading washer in which an inlet 101*a* for inserting or withdrawing is arranged on a front surface of the cabinet 101 as illustrated in FIG. 4. In other words, the washer 100 according to an embodiment is not limited to the top-loading washer or the front-loading washer, and either the top-loading washer or the front-loading washer may be used. Alternatively, the washer 100 may include a washer of another loading type other than the top-loading washer and the front-loading washer.

A door 102 configured to open and close the inlet 101*a* is arranged on one surface of the cabinet 101. The door 102 may be arranged on the same surface as the inlet 101*a*, and may be rotatably mounted to the cabinet 101 by a hinge.

The control panel 110 configured to provide a user interface for interaction with a user may be arranged on one surface of the cabinet 101.

The control panel 110 may include an input button 111 configured to obtain a user input, and a display 112 provided to display laundry setting or laundry operation information in response to the user input.

The input button 111 may include a power button, an operation button, a course selection dial (or a course selection button), and a washing/rinsing/drying set button. The input button may include a tact switch, a push switch, a slide switch, a toggle switch, a micro switch, ora touch switch.

The input button 111 may provide an electrical output signal corresponding to a user input to the processor 190.

The display 112 may include a screen provided to display a washing course selected by rotation of the course selection dial (or pressing a course selection button) and an operating time of the washer, and an indicator provided to display a washing setting/rinsing setting/spin-drying setting selected by the setting button. The display may include a liquid crystal display (LCD) panel, a light emitting diode (LED) panel, and the like.

The display 112 may receive information to be displayed from the processor 190 and display information corresponding to the received information.

The tub 120 may be arranged inside the cabinet 101. The tub 120 may accommodate water for washing or rinsing.

The tub 120 may be formed in a cylindrical shape with one bottom open. The tub 120 may include a substantially circular tub bottom 122 and a tub sidewall 121 provided along a circumference of the tub bottom 122. Another bottom surface of the tub 120 may be opened or an opening may be formed thereon to allow the laundry to be inserted or withdrawn.

In the case of the top-loading washer, as illustrated in FIG. 3, the tub 120 may be arranged such that the tub bottom 122 faces a floor of the washer and a central axis R of the tub sidewall 121 is approximately perpendicular to the floor. In addition, in the case of the front-loading washer, as illustrated in FIG. 4, the tub 120 may be arranged such that the tub bottom 122 faces the rear of the washer and a central axis R of the tub sidewall 121 is approximately parallel to the floor.

A bearing 122*a* provided to rotatably fix the motor 140 may be provided on the tub bottom 122.

The drum 130 may be rotatably provided inside the tub 120. The drum 130 may accommodate laundry, that is, a load.

The drum 130 may be formed in a cylindrical shape with one bottom open.

The drum 130 may include a substantially circular drum bottom 132 and a drum sidewall 131 provided along a circumference of the drum bottom 132. Another bottom surface of the drum 130 may be opened or an opening may be formed thereon to allow the laundry to be inserted into or withdrawn from the drum 130.

In the case of the top-loading washer, as illustrated in FIG. 3, the drum 130 may be arranged such that the drum bottom 132 faces the floor of the washer and the central axis R of the drum sidewall 131 is approximately perpendicular to the floor. In addition, in the case of the front-loading washer, as illustrated in FIG. 4, the drum 130 may be arranged such that the drum bottom 132 faces the rear of the washer and the central axis R of the drum side wall 131 is approximately parallel to the floor.

A through hole 131*a* provided to connect an inside and the outside of the drum 130 may be provided in the drum sidewall 131 to allow the water supplied to the tub 120 to be introduced into the inside of the drum 130.

In the case of the top-loading washer, as illustrated in FIG. 3, a pulsator 133 may be rotatably provided inside the drum bottom 132. The pulsator 133 may be rotated independently of the drum 130. In other words, the pulsator 133 may be rotated in the same direction as the drum 130 or rotated in a different direction. The pulsator 133 may be also rotated at the same rotational speed as the drum 130 or rotated at a different rotational speed.

In the case of the front-loading washer, as illustrated in FIG. 4, a lifter 131*b* is provided on the drum sidewall 131 to lift the laundry to an upper portion of the drum 130 during the drum 130 is rotated.

The drum bottom 132 may be connected to a rotating shaft 141 of the motor 140 configured to rotate the drum 130.

The motor 140 may generate a torque for rotating the drum 130.

The motor 140 may be provided outside the tub bottom 122 of the tub 120, and may be connected to the drum bottom 132 of the drum 130 through the rotating shaft 141. The rotating shaft 141 may penetrate the tub bottom 122 and may be rotatably supported by the bearing 122*a* provided on the tub bottom 122.

The motor 140 may include a stator 142 fixed to the outside of the tub bottom 122, and a rotor 143 configured to be rotatable with respect to the tub 120 and the stator 142. The rotor 143 may be connected to the rotating shaft 141.

The rotor 143 may be rotated through the magnetic interaction with the stator 142, and the rotation of the rotor 143 may be transmitted to the drum 130 through the rotating shaft 141.

The motor 140 may include a brushless direct current motor (BLDC Motor) or a permanent magnet synchronous motor (PMSM), which facilitates control of the rotational speed.

In the case of the top-loading washer, as illustrated in FIG. 3, a clutch 145 configured to transmit the torque of the motor 140 to both of the pulsator 133 and the drum 130, or to transmit the torque of the motor 140 to only the pulsator 133 may be provided. The clutch 145 may be connected to the rotating shaft 141. The clutch 145 may distribute the rotation of the rotating shaft 141 to an inner shaft 145*a* and an outer shaft 145*b*. The inner shaft 145*a* may be connected to the pulsator 133. The outer shaft 145*a* may be connected to the drum bottom 132. The clutch 145 may transmit the rotation of the rotating shaft 141 to both of the pulsator 133 and the drum 130 through the inner shaft 145*a* and the outer shaft 145*b* or transmit the rotation of the rotating shaft 141 to only the drum 130 through the inner shaft 145*a*.

The water supplier 150 may supply water to the tub 120 and the drum 130. The water supplier 150 includes a water supply conduit 151 connected to an external water supply source to supply water to the tub 120, and a water supply valve 152 arranged on the water supply conduit 151. The water supply conduit 151 may be arranged on an upper side of the tub 120 and extend from the external water supply source to a detergent box 156. Water is guided to the tub 120 through the detergent box 156. The water supply valve 152 may allow or block supply of water from the external water supply source to the tub 120 in response to an electrical signal. The water supply valve 152 may include a solenoid valve configured to open and close in response to an electrical signal.

The detergent supplier 155 may supply detergent to the tub 120 and the drum 130. The detergent supplier 155 includes the detergent box 156 arranged on the upper side of the tub 120 to store detergent, and a mixing conduit 157 provided to connect the detergent box 156 to the tub 120. The detergent box 156 may be connected to the water supply conduit 151, and water supplied through the water supply conduit 151 may be mixed with the detergent of the detergent box 156. A mixture of detergent and water may be supplied to the tub 120 through the mixing conduit 157.

The drain 160 may discharge the water accommodated in the tub 120 or the drum 130 to the outside. The drain 160 may include a drainage conduit 161 provided under the tub 120 and extend from the tub 120 to the outside of the cabinet 101. In the case of the top-loading washer, as illustrated in FIG. 3, the drain 160 may further include a drain valve 162 provided in the drain conduit 161. In the case of the front-loading washer, as illustrated in FIG. 4, the drain 160 may further include a drain pump 163 arranged on the drain conduit 161.

The water level sensor 170 may be installed at an end of a connection hose connected to a lower portion of the tub 120. In this case, a water level of the connection hose may be the same as a water level of the tub 120. As the water level of the tub 120 is increased, the water level of the connection hose may be increased, and a pressure inside the connection hose may be increased due to the increase of the water level of the connection hose.

The water level sensor 170 may measure the pressure inside the connection hose, and may output an electrical signal corresponding to the measured pressure to the processor 190. The processor 190 may identify the water level of the connection hose, that is, the water level of the tub 110, based on the pressure of the connection hose measured by the water level sensor 170.

The motor drive 200 may receive a driving signal from the processor 190, and provide a driving current for rotating the rotating shaft 141 of the motor 140 to the motor 140 based on the driving signal of the processor 190. The motor drive 200 may provide the driving current value supplied to the motor 140 and the rotational speed of the rotor of the motor 140 to the processor 190.

As illustrated in FIGS. 5 and 6, the motor drive 200 may include a rectifier circuit 210, a direct current (DC) link circuit 220, an inverter circuit 230, a current sensor 240 or a drive processor 250. Further, the motor 140 may be provided with a position sensor 270 configured to measure the rotational displacement (electrical angle of the rotor) of the rotor 143.

The rectifier circuit 210 may include a diode bridge including a plurality of diodes D1, D2, D3, and D4, and may rectify AC power of the external power source (ES).

The DC link circuit 220 may include a DC link capacitor C1 configured to store electrical energy, and the DC link circuit 220 may remove a ripple of the rectified power, and output DC power.

The inverter circuit 230 may include three pairs of switching elements Q1 and Q2, Q3 and Q4, Q5 and Q6, and convert the DC power of the DC link circuit 220 into DC or AC driving power. The inverter circuit 230 may also supply a driving current to the motor 140.

The current sensor 240 may measure a total current output from the inverter circuit 230 or measure each of the three-phase driving currents (a-phase current, b-phase current, and c-phase current) output from the inverter circuit 230.

The position sensor 270 may be arranged in the motor 140, and measure the rotational displacement (e.g., the electric angle of the rotor) of the rotor 143 of the motor 140, and output positional data θ indicating the electric angle of the rotor 143. The position sensor 270 may be implemented as a Hall sensor, an encoder, a resolver, or the like.

The drive processor 250 may be provided integrally with the processor 190 or provided separately from the processor 190.

The drive processor 250 may include an application specific integrated circuit, (ASIC) configured to output a driving signal to the inverter circuit 230 based on the target speed command ω*, the driving current value, and the rotational displacement θ of the rotor 143. Alternatively, the drive processor 250 may include a memory configured to store a series of instructions for outputting a driving signal based on the target speed command ω*, the driving current value, and the rotational displacement θ of the rotor 143, and a processor configured to process the series of instructions stored in the memory.

A structure of the drive processor 250 may depend on the type of the motor 140. In other words, the drive processors 250 including different structures may control different types of motors 140.

For example, when the motor 140 is a BLDC motor, the drive processor 250 may include a speed calculator 251, a speed controller 253, a current controller 254, and a pulse width modulator 256, as illustrated in FIG. 5.

The drive processor 250 may control a DC voltage applied to the BLDC motor by using pulse width modulation (PWM). Accordingly, the driving current supplied to the BLDC motor may be controlled.

The speed calculator 251 may calculate a rotational speed value w of the motor 140 based on a rotor electric angle θ of the motor 140. For example, the speed calculator 251 may calculate the rotational speed value w of the motor 140 based on a magnitude of change in the electric angle θ of the rotor 143 received from the position sensor 270. As another example, the speed calculator 251 may calculate the rotational speed value w of the motor 140 based on a change in the driving current value measured by the current sensor 240.

The speed controller 253 may output a current command I* based on a difference between the target speed command ω* of the processor 190 and the rotational speed value ω of the motor 140. For example, the speed controller 253 may include a proportional integral controller (PI controller).

The current controller 254 may output a voltage command V* based on the difference between the current command I* output from the speed controller 253 and the measured current value I measured by the current sensor 240. For example, the current controller 254 may include a PI controller.

The pulse width modulator 256 may output a PWM control signal Vpwm for controlling the magnitude of the driving current that is supplied by the inverter circuit 230 to the motor 140 based on the voltage command V*.

As mentioned above, the drive processor 250 may control the magnitude of the driving current supplied by the inverter circuit 230 to the motor 140 based on the target speed command ω* received from the processor 190.

The drive processor 250 may supply a driving current including a sinusoidal waveform to the motor 140, in response to the target speed command ω* including the sinusoidal waveform. For example, the speed controller 253 may output the current command I* including the sinusoidal waveform, in response to the target speed command ω* including the sinusoidal waveform. Further, the current controller 254 may output a voltage command V* including a sinusoidal waveform, in response to the current command I* including the sinusoidal waveform.

Further, the drive processor 250 may supply a driving current including a sinusoidal waveform to the motor 140, in response to a load measurement command of the processor 190. For example, the speed controller 253 may output a current command I* including a sinusoidal waveform, in response to the load measurement command of the processor 190. The speed controller 253 may output the current command I* in which a current command of a sinusoidal waveform is superimposed on a current command based on a difference between the target speed command ω* and the rotational speed value w. Further, the current controller 254 may output a voltage command V* including a sinusoidal waveform, in response to the load measurement command of the processor 190. The current controller 254 may output the voltage command V* in which a voltage command of a sinusoidal waveform is superimposed on a voltage command based on a difference between the current command I* and the measured current I.

As another example, when the motor 140 is a PMSM, the drive processor 250 may include a speed calculator 251, an input coordinate converter 252, a speed controller 253, a current controller 254, an output coordinate converter 255, and a pulse width modulator 256, as illustrated in FIG. 6.

The drive processor 250 may control the AC voltage applied to the PMSM using vector control. Accordingly, the driving current supplied to the PMSM may be controlled.

The speed calculator 251 may be the same as the speed calculator 251 illustrated in FIG. 5.

The input coordinate converter 252 may convert a three-phase driving current value Iabc to a d-axis current value Id and a q-axis current value Iq (hereinafter, d-axis current and q-axis current) based on a rotor electrical angle θ. The d-axis may represent an axis in a direction coincident with the direction of the magnetic field generated by the rotor of the motor 140. In addition, the q-axis may represent an axis in a direction 90 degrees ahead of the direction of the magnetic field generated by the rotor of the motor 140.

The speed controller 253 may calculate a q-axis current command Iq* to be supplied to the motor 140 based on a difference between the target speed command ω* of the processor 190 and the rotational speed value w of the motor 140. Further, the speed controller 253 may determine the d-axis current command Id*.

The current controller 254 may determine a q-axis voltage command Vq* based on a difference between the q-axis current command Iq* output from the speed controller 253 and the q-axis current value Iq output from the input coordinate converter 252. Further, the current controller 254 may determine a d-axis voltage command Vd* based on a difference between the d-axis current command Id* and the d-axis current value Id.

The output coordinate converter 255 may convert a dq-axis voltage command Vdq* to a three-phase voltage command Vabc* (a-phase voltage command, b-phase voltage command, and c-phase voltage command) based on the rotor electrical angle θ of the motor 140.

The pulse width modulator 256 may output a PWM control signal Vpwm for controlling the magnitude of the driving current that is supplied to the motor 140 by the inverter circuit 230 from the three-phase voltage command Vabc*.

As mentioned above, the drive processor 250 may control the magnitude of the driving current supplied by the inverter circuit 230 to the motor 140 based on the target speed command ω* received from the processor 190.

The drive processor 250 may supply a driving current including a sinusoidal waveform to the motor 140, in response to the target speed command ω* including the sinusoidal waveform. For example, the speed controller 253 may output a q-axis current command Iq* including a sinusoidal waveform, in response to the target speed command ω* including the sinusoidal waveform. Further, the current controller 254 may output a q-axis voltage command Vq* including a sinusoidal waveform, in response to the q-axis current command Iq* including the sinusoidal waveform.

Further, the drive processor 250 may supply a driving current including a sinusoidal waveform to the motor 140, in response to the load measurement command of the processor 190. For example, the speed controller 253 may output a q-axis current command Iq* with a sinusoidal waveform in response to a load measurement command from the processor 190. The speed controller 253 may output a q-axis current command Iq*, in which a current command of a sinusoidal waveform is superimposed on a current command based on a difference between the target speed command ω* and the rotational speed value w. Further, the current controller 254 may output a q-axis voltage command Vq* including a sinusoidal waveform in response to a load measurement command of the processor 190. For example, the current controller 254 may output a q-axis voltage command Vq* in which a voltage command of a sinusoidal waveform is superimposed on a voltage command based on the difference between the q-axis current command Iq* and the measured q-axis current Iq.

The processor 190 may be mounted on a printed circuit board provided on a rear surface of the control panel 110.

The processor 190 may be electrically connected to the control panel 110, the water level sensor 170, the motor drive 200, the water supply valve 152, or the drain valve 162/drain pump 163.

The processor 190 may process an output signal of the control panel 110, the water level sensor 170, or the motor drive 200, and the processor 190 may provide a control signal to the motor drive 200, the water supply valve 152, and the drain valve 162/the drain pump 163 based on processing the output signal.

The processor 190 may include a memory 191 configured to store or memorize a program (a plurality of instructions) or data for processing a signal and providing a control signal. The memory 191 may include a volatile memory such as Static Random Access Memory (S-RAM) and Dynamic Random Access Memory (D-RAM), and a non-volatile memory such as Read Only Memory (ROM), and Erasable Programmable Read Only Memory (EPROM). The memory 191 may be provided integrally with the processor 190 as illustrated in FIG. 2 or may be provided as a semiconductor device separated from the processor 190.

The processor 190 may further include a processing core (e.g., an arithmetic circuit, a memory circuit, and a control circuit) configured to process a signal based on a program or data stored in the memory 191 and configured to output a control signal.

The processor 190 may receive a user input from the control panel 110 and process the user input. The processor 190 may provide a control signal to the motor drive 200, the water supply valve 152, and the drain valve 162/the drain pump 163 to sequentially perform the washing cycle, the rinsing cycle, and the spin-drying cycle in response to a user input signal.

The processor 190 may receive a water level measured by the water level sensor 170. The processor 190 may provide a water supply signal to the water supply valve 152 or a drain signal to the drain valve 162/the drain pump 163 based on the comparison between the measured water level and the target water level.

The processor 190 may provide a driving signal to the motor drive 200 to allow the motor 140 to rotate the drum 130. For example, the processor 190 may provide a driving signal for the washing to the motor drive 200. In addition, the processor 190 may provide a driving signal for the spin-drying to the motor drive 200.

The processor 190 may provide a driving signal for measuring a load to the motor drive 200.

For example, the processor 190 may provide a target speed command, in which a sinusoidal waveform is superimposed, for measuring a load to the motor drive 200. The motor drive 200 may supply a driving current including the sinusoidal current to the motor 140 in response to the target speed command on which the sinusoidal waveform is superimposed.

As another example, the processor 190 may provide a load measurement signal for measuring a target rotational speed and a load to the motor drive 200. The motor drive 200 may supply a driving current including a sinusoidal waveform to the motor 140 in response to the load measurement signal.

The processor 190 may receive a driving current value and a rotational speed of the motor 140 supplied to the motor 140 from the motor drive 200. The processor 190 may measure the weight of the laundry accommodated in the drum 130, i.e., a load, based on the driving current value of the motor 140 and the rotational speed of the motor 140.

For example, the processor 190 may identify an amplitude of the change in the driving current based on the value of the driving current of the motor 140, and identify an amplitude of the change in the rotational acceleration based on the rotational speed of the motor 140. The processor 190 may identify a moment of inertia by the drum 130 and the load, based on a ratio between the amplitude of the change in driving current and the amplitude of the change in rotational acceleration. The processor 190 may identify the magnitude of the load accommodated in the drum 130 based on the moment of inertia caused by the drum 130 and the load.

Further, based on the identified load, the processor 190 may set the water level of the tub 120 or identify whether a waterproof fabric (e.g., waterproof clothing or waterproof bedding) is included in the laundry, or identify a moisture content of laundry during the spin-drying.

Figure 7:
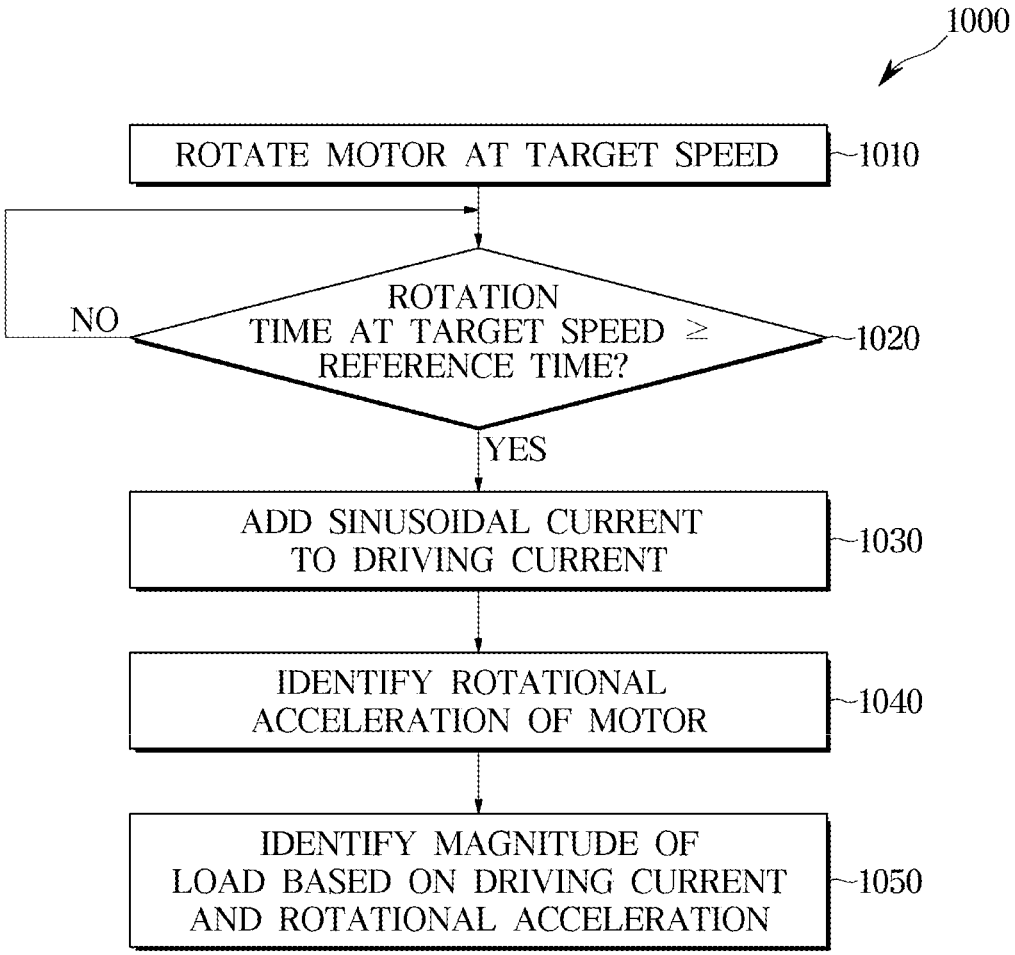
FIG. 7 illustrates a method of measuring a load of the washer according to an embodiment of the disclosure.
Figure 8:
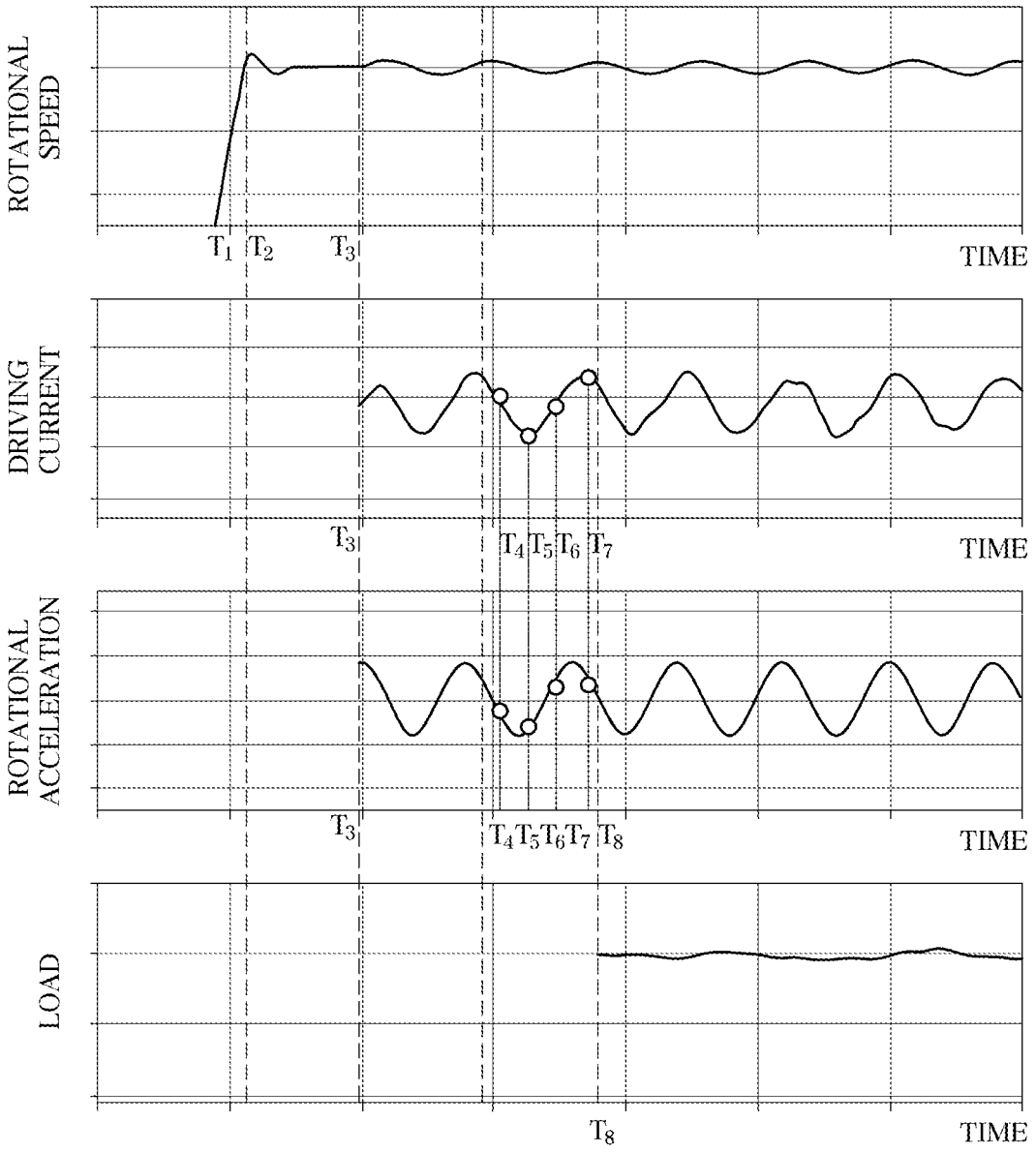
FIG. 8 illustrates a rotational speed of the motor, a driving current of the motor, a rotational acceleration of the motor, and a load of the motor measured by the method illustrated in FIG. 7.
Figure 9:
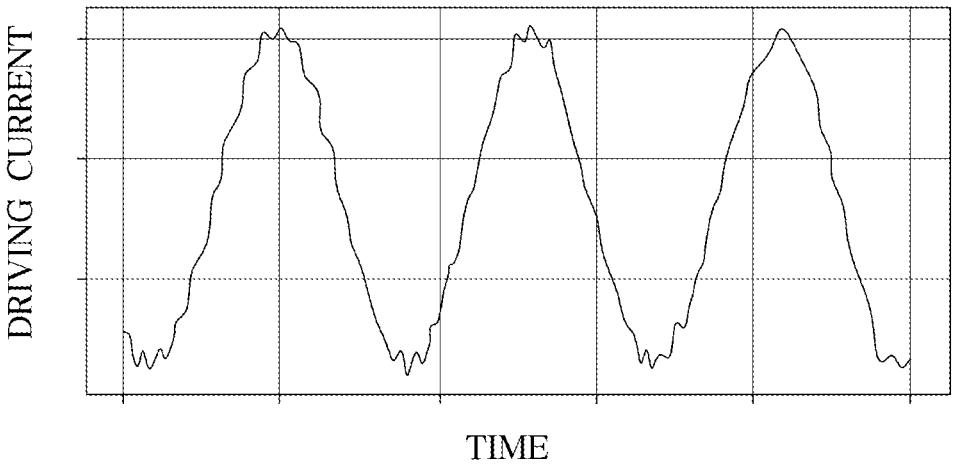
FIG. 9 illustrates the driving current of the motor on which a sinusoidal waveform is superimposed by the method illustrated in FIG. 7.
Figure 10:
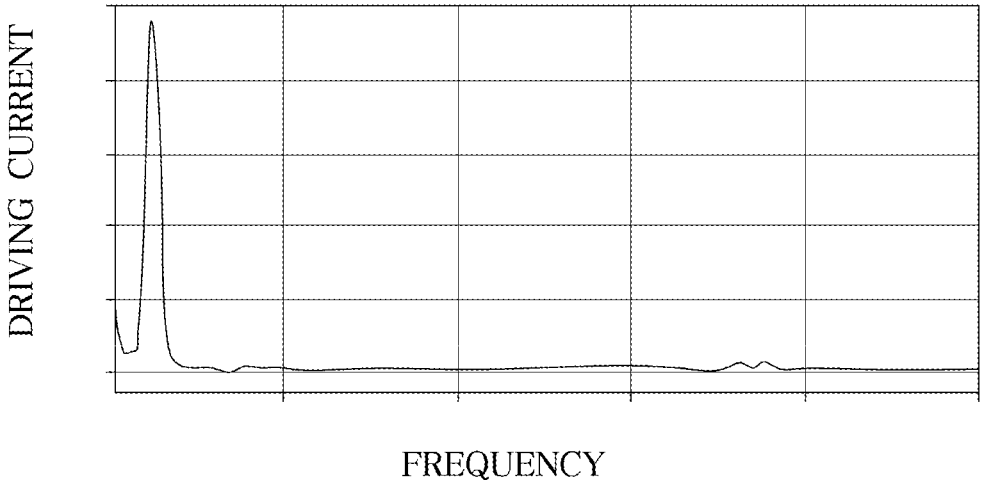
FIG. 10 illustrates a spectrum of the driving current of the motor illustrated in FIG. 9.
Figure 11:
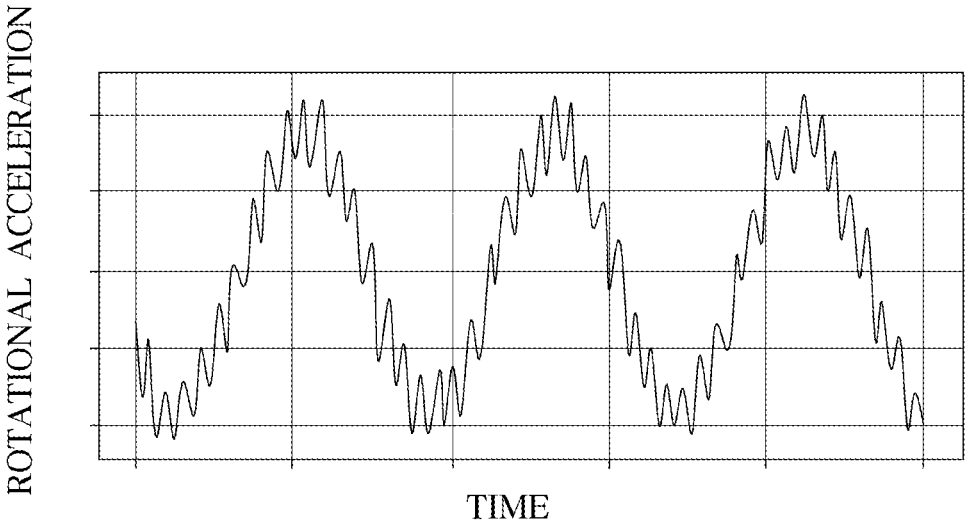
FIG. 11 illustrates a rotational acceleration of the motor on which the sinusoidal waveform is superimposed by the method illustrated in FIG. 7.
Figure 12:
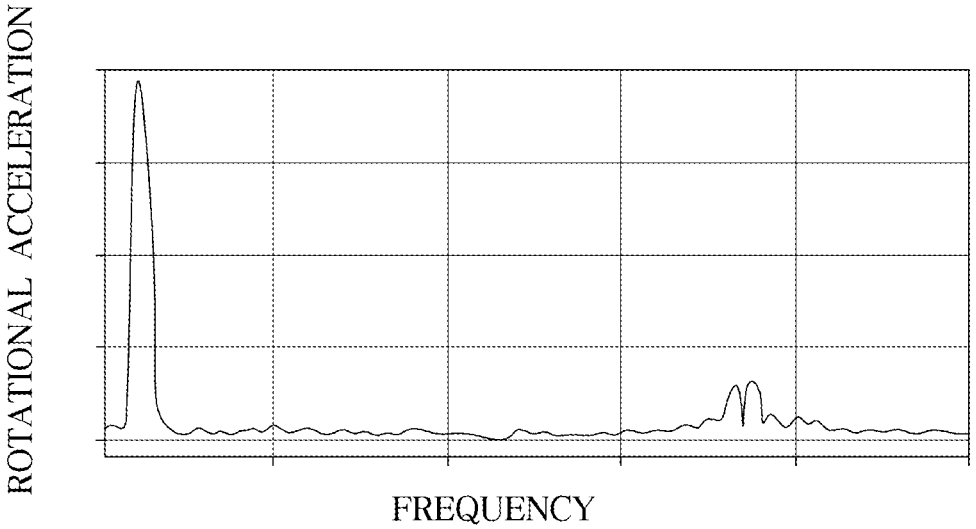
FIG. 12 illustrates a spectrum of the rotational acceleration of the motor illustrated in FIG. 11.

FIG. 7 illustrates a method of measuring a load of the washer according to an embodiment of the disclosure. FIG. 8 illustrates a rotational speed of the motor, a driving current of the motor, a rotational acceleration of the motor, and a load of the motor measured by the method illustrated in FIG. 7. FIG. 9 illustrates the driving current of the motor on which a sinusoidal waveform is superimposed by the method illustrated in FIG. 7. FIG. 10 illustrates a spectrum of the driving current of the motor illustrated in FIG. 9. FIG. 11 illustrates a rotational acceleration of the motor on which the sinusoidal waveform is superimposed by the method illustrated in FIG. 7. FIG. 12 illustrates a spectrum of the rotational acceleration of the motor illustrated in FIG. 11.

A method 1000 in which the washer 100 measures the load accommodated in the drum 130 is described with reference to FIGS. 7, 8, 9, 10, 11 and 12.

The rotation of the drum 130 is governed by [Equation 1] representing the following rotor dynamics equation.

$$\tau = Ja + b\omega + c. \quad \text{[Equation 1]}$$

Where T represents the torque applied to the rotating body (drum), J represents the moment of inertia of the rotating body (drum), a represents the rotational acceleration, ω represents the rotational speed, b represents the viscous friction coefficient, and c represents Coulomb friction.

The right side of [Equation 1] may be divided into "Ja" and "bω+c" by the rotational moment and rotational acceleration. At this time, when the change in the rotational speed is small, the rotational speed w and the viscous friction coefficient b are small values, and thus "bω+c" may be treated as a constant.

According to [Equation 1], the torque applied to the drum 130 may be proportional to the rotational acceleration of the drum 130, and the ratio of the torque applied to the drum 130 to the rotational acceleration of the drum 130 may be equal to the moment of inertia of the drum 130. In addition, the torque applied to the drum 130 by the motor 140 may be proportional to the magnitude of the driving current supplied to the motor 140.

Accordingly, the washer 100 may identify the moment of inertia of the drum 130 based on the driving current supplied to the motor 140 and the rotational acceleration of the drum 130. In other words, the washer 100 may identify the magnitude of the load accommodated in the drum 130 based on the driving current supplied to the motor 140 and the rotational acceleration of the drum 130.

The washer 100 may rotate the motor 140 at a target speed (1010).

The processor 190 may provide a target speed command to the motor drive 200 to rotate the motor 140 at the target speed.

For example, before starting the washing of the washer 100, the processor 190 may rotate the motor 140 at a first speed to measure a dry load (a weight of laundry that does not absorb water for washing) accommodated in the drum 130.

As another example, before starting the spin-drying in the washer 100, the processor 190 may rotate the motor 140 at a second speed to measure a wet load (a weight of laundry that absorbs water for washing) accommodated in the drum 130.

As another example, during the spin-drying in the washer 100, the processor 190 may rotate the motor 140 at a third speed to measure the wet load accommodated in the drum 130.

The processor 190 may increase the rotational speed of the motor 140 stepwise or linearly or gradually until the rotational speed of the motor 140 reaches the target speed. In other words, the processor 190 may provide the motor drive 200 with a target speed command for the stepwise or linear or gradual increase, to allow the motor 140 to be accelerated.

Accordingly, the rotational speed of the motor 140 may be increased stepwise or linearly or gradually between time T1 and time T2 as illustrated in FIG. 8.

The washer 100 identifies whether a time, for which the motor 140 is rotated at the target speed, is equal to or greater than a reference time (1020). In response to the time, for which the motor 140 is rotated at the target speed, being less than the reference time (no in 1020), the washer 100 may wait until the rotational speed of the motor 140 is stabilized.

The processor 190 may wait for a reference time after the motor 140 reaches the target speed. The reference time is a time required for the rotational speed of the motor 140 to be stabilized, and may be set experimentally or empirically.

For example, in a state in which the load is small, an overshoot in which the rotational speed of the motor 140 exceeds the target speed may occur at a point of time in which the rotational speed of the motor 140 reaches the target speed. Due to the overshoot, the rotation (rotational speed and rotation acceleration) of the motor 140 may change due to external factors other than the driving current supplied to the motor 140. In order to exclude the rotation of the motor 140 caused by the external factors, the processor 190 may wait for the rotational speed of the motor 140 to be stabilized.

Accordingly, the rotational speed of the motor 140 may be stabilized between time T2 and time T3, as illustrated in FIG. 8.

In response to the time, for which the motor 140 is rotated at the target speed, being equal to or greater than the reference time (yes in 1020), the washer 100 may add a sinusoidal current to the driving current supplied to the motor 140 (1030).

The processor 190 may control the motor drive 200 to allow a sinusoidal waveform to be superimposed on the driving current supplied to the motor 140.

For example, the processor 190 may add a sinusoidal waveform to the target speed command supplied to the motor drive 200. The processor 190 may provide the target speed command that changes over time with a sinusoidal waveform, to the motor drive 200.

In order to minimize the change in the rotational speed of the motor 140 during the load measurement, an amplitude of the added sinusoidal waveform may be minimized. For example, the amplitude of the added sinusoidal waveform may be a predetermined value (e.g., 5 RPM or less). Further, the amplitude of the added sinusoidal waveform may depend on the target speed. The amplitude of the added sinusoidal waveform may be 5% or less of the target speed (e.g., 5 RPM or less in response to the target speed of 100 RPM). Alternatively, the amplitude of the added sinusoidal waveform may be 0.5% or less of the maximum rotational speed for the spin-drying (e.g., 5 RPM or less in response to the target speed of 1000 RPM).

However, the disclosure is not limited thereto, and the amplitude of the sinusoidal waveform may be 2% or less of the target speed (e.g., 2 RPM or less in response to the target speed of 100 RPM). Alternatively, the amplitude of the added sinusoidal waveform may be 0.2% or less of the maximum rotational speed for the spin-drying (e.g., 2 RPM or less in response to the target speed of 1000 RPM).

An influence may occur by the movement of the laundry accommodated in the drum 130 during the load measurement. For example, in the case of the front-loading washer, laundry accommodated in the drum 130 may fall during the drum 130 is rotated at a low speed, thereby changing the rotational acceleration. In order to minimize the influence of the movement of laundry accommodated in the drum 130 during the load measurement, a frequency of the added sinusoidal waveform may be different from a frequency corresponding to the target speed. For example, the frequency of the added sinusoidal waveform may be less than the frequency corresponding to the target speed.

The motor drive 200 may provide a driving current on which the sinusoidal waveform is superimposed to the motor 140 in response to the target speed command on which the sinusoidal waveform is superimposed. Further, the motor drive 200 may provide the value of the driving current, on which the sinusoidal waveform is superimposed, to the processor 190.

As another example, the processor 190 may provide the motor drive 200 with a load measurement command for adding a sinusoidal current to the driving current together with the target speed command. In response to the load measurement command, the motor drive 200 may provide the motor 140 with a driving current in which the sinusoidal current is added to a current based on the target speed command.

In order to minimize the change in the rotational speed of the motor 140 during the load measurement, the amplitude of the added sinusoidal current may be minimized. For example, the amplitude of the sinusoidal current may be limited within a predetermined range. Further, the amplitude of the sinusoidal current may depend on the target speed.

In addition, in order to minimize the influence of the movement of laundry accommodated in the drum 130 during the load measurement, the frequency of the added sinusoidal current may be different from the frequency corresponding to the target speed. For example, the frequency of the added sinusoidal current may be less than a frequency corresponding to the target speed.

Further, the motor drive 200 may provide the value of the driving current, to which the sinusoidal current is added, to the processor 190.

The washer 100 may identify the rotational angular velocity of the motor 140 by the driving current including the sinusoidal waveform (1040).

The motor drive 200 may identify a rotational displacement of the rotor 143 of the motor 140. For example, the motor drive 200 may identify the rotational displacement (electric angle) of the rotor 143 based on the output signal of the position sensor 270 provided in the motor 140. As another example, the motor drive 200 may identify the rotational displacement (electric angle) of the rotor 143 based on a change in the current caused by the counter electromotive force of the motor 140.

The motor drive 200 may identify the rotational speed (angular velocity) of the rotor 143. For example, the motor drive 200 may identify the rotational speed of the rotor 143 based on a change in the rotational displacement of the rotor 143 per unit time.

The motor drive 200 may provide information about the rotational speed of the rotor 143 to the processor 190.

The motor drive 200 may provide the rotational speed value of the rotor 143 to the processor 190 for each sampling period. As illustrated in FIG. 8, the motor drive 200 may provide the rotational speed value of the rotor 143 to the processor 190 at times T4, T5, T6, T7 . . . .

The processor 190 may identify the rotational acceleration (angular acceleration) of the rotor 143. For example, for each sampling period, the processor 190 may identify the rotational acceleration of the rotor 143 based on a change in the rotational speed of the rotor 143. As illustrated in FIG. 8, the processor 190 may identify a rotational acceleration value of the rotor 143 at time T4, T5, T6, T7 . . . .

In addition, the motor drive 200 may identify the rotational acceleration of the rotor 143 based on the change in the rotational speed of the rotor 143 per unit time, and transmit information about the rotational acceleration of the rotor 143 to the processor 190.

The washer 100 may identify the magnitude of the load based on the driving current and the rotational acceleration (1050).

The processor 190 may identify the magnitude of the load accommodated in the drum 130 based on the driving current value and the rotational acceleration value obtained for each sampling period.

In order to remove a direct current (DC) component and a noise component included in the driving current value, the processor 190 may filter the driving current value (the sampled driving current value) obtained from the motor drive 200 for each sampling period.

As illustrated in FIG. 9, the driving current may include a first driving current for rotating the drum 130 at a target speed, a second driving current by a sinusoidal component included in the target speed, and a third driving current for compensating for the movement of laundry in the drum 130.

A frequency spectrum of the driving current may include a DC component for rotating the drum 130 at a target speed, a frequency component by the target speed of the sinusoidal wave, and a frequency component corresponding to the rotational speed (target speed) of the drum 130. The frequency component according to the target speed of the sinusoidal wave and the frequency component corresponding to the rotational speed (target speed) of the drum 130 may be as illustrated in FIG. 10.

The processor 190 may filter the driving current to remove the DC component and the frequency component corresponding to the rotational speed (target speed) of the drum 130.

For example, the processor 190 may filter the driving current value by using a band pass filter (BPF) having the frequency of the sinusoidal wave added to the target speed (or the frequency of the sinusoidal current added to the driving current), as a center frequency. Accordingly, the DC component and the frequency component corresponding to the rotational speed of the drum 130 included in the driving current value may be removed.

However, filtering the sampled driving current value is not limited to filtering the driving current value using a band pass filter. For example, the filtering of the sampled driving current value may include filtering the driving current value using a low pass filter (LPF) for removing the DC component. In addition, the filtering of the sampled driving current value may include filtering the driving current value using a high pass filter (HPF) for removing the frequency component corresponding to the rotational speed of the drum 130.

In order to remove a noise component included in the rotational acceleration value, the processor 190 may filter the rotational acceleration value (sampled rotational acceleration value) obtained from the motor drive 200 for each sampling period.

As illustrated in FIG. 11, the rotational acceleration may include a first rotational acceleration by a sinusoidal component included in the target speed, and a second rotational acceleration by the movement of laundry in the drum 130.

As illustrated in FIG. 12, a frequency spectrum of the rotational acceleration may include a frequency component by the target speed of the sinusoidal wave and a frequency component corresponding to the rotational speed (target speed) of the drum 130.

The processor 190 may filter the rotational acceleration to remove a frequency component corresponding to the rotational speed (target speed) of the drum 130.

For example, the processor 190 may filter the rotational acceleration value by using a band pass filter (BPF) having the frequency of the sinusoidal wave added to the target speed (or the frequency of the sinusoidal current added to the driving current), as a center frequency. Accordingly, the DC component and the frequency component corresponding to the rotational speed of the drum 130 included in the rotational acceleration value may be removed. Alternatively, the processor 190 may filter the rotational acceleration value using a low-pass filter or a high-pass filter.

The processor 190 may identify the amplitude of the sampled driving current value and the amplitude of the sampled rotational acceleration value using the driving current model and the rotational acceleration model.

The driving current generated by the target speed of the sinusoidal waveform may be modeled as a cosine function (or sine function) as illustrated in [Equation 2], and the rotational acceleration may be modeled as illustrated in [Equation 3].

$$i(t)=I\cos(\theta-\alpha)=I\cos\alpha^*\cos\theta+I\sin\alpha^*\sin\theta \quad \text{[Equation 2]}$$

Where i(t) represents the modeled driving current, I represents the amplitude of the driving current, a represents the phase delay of the driving current, and θ represents the phase of the sinusoidal waveform added to the target speed.

$$a(t)=A\cos(\theta-\beta)=A\cos\beta^*\cos\theta+A\sin\beta^*\sin\theta. \quad \text{[Equation 2]}$$

Where a(t) represents the modeled rotational acceleration, A represents the amplitude of the rotational acceleration, and β represents the phase delay of the rotational acceleration.

θ represents the phase of the sinusoidal wave at the time of sampling of the driving current and rotational acceleration. Accordingly, the processor 190 may identify the value of cos θ and the value of sin θ. Further, because i(t) represents the modeled driving current value, the processor 190 may identify the value of i(t).

Therefore, [Equation 2] and [Equation 3] may be simplified as [Equation 4] and [Equation 5], respectively.

$$z_i=Mx_i+Ny_i. \quad \text{[Equation 4]}$$

Where zi represents the i-th sampled driving current value, M represents the product of the amplitude of the driving current and cos α, xi represents the cosine function value of the phase of the sinusoidal waveform added to the target speed at the i-th sampling, N represents the product of the amplitude of the driving current and sin α, and yi represents the sine function value of the phase of the sinusoidal waveform added to the target speed at the i-th sampling.

$$z_i'=M'x_i'+N'y_i'. \quad \text{[Equation 2]}$$

Where zi' represents the i-th sampled rotational acceleration value, M' represents the product of the amplitude of the rotational acceleration and cos α, and xi' represents the cosine function value of the phase of the sinusoidal waveform added to the target speed at the i-th sampling, N' represents the product of the amplitude of rotational acceleration and sin α, and yi' represents the sine function value of the phase of the sinusoidal waveform added to the target speed at the i-th sampling.

The processor 190 may identify a driving current value zi obtained by sampling of the driving current value, a cosine function value xi of the phase of the sinusoidal waveform, and a sine function value yi of the phase of the sinusoidal waveform, respectively. For example, the processor 190 may generate (z1, x1, y1), (z2, x2, y2), (z3, x3, y3) . . . (zi, xi, yi) through the sampling of the driving current value.

For example, the processor 190 may identify values of M and N in [Equation 4] using the least squares method. The processor 190 may identify the values of M and N by applying the least squares method to [Equation 4] to which (z1, x1, y1), (z2, x2, y2), (z3, x3, y3) . . . (zi, xi, yi) is given.

As another example, the processor 190 may identify the values of M and N in [Equation 4] using the recursive least squares method.

For example, as illustrated in FIG. 8, the processor 190 may initialize parameters for applying the regressive least squares method using the least squares method at times T4, T5, T6, and T7.

As illustrated in FIG. 8, at time T8, the processor 190 may identify the values of M and N by using the regressive least squares method by applying parameters that are initialized at times T4, T5, T6, and T7.

Because M represents the product of the amplitude of the driving current and cos α and N represents the product of the amplitude of the driving current and sin α, the processor 190 may identify the amplitude I of the driving current using [Equation 6].

$$I=\sqrt{M^2+N^2}. \quad \text{[Equation 6]}$$

Where I represents the amplitude of the driving current, M represents the product of the amplitude of the driving current and cos α, and N represents the product of the amplitude of the driving current and sin α.

In addition, the processor 190 may identify a rotational acceleration value zi' obtained by sampling of the rotational acceleration value, a cosine function value xi' of the phase of the sinusoidal waveform, and a sine function value yi' of the phase of the sinusoidal waveform, respectively. For example, the processor 190 may obtain (z1', x1', y1'), (z2', x2', y2'), (z3', x3', y3') . . . (zi', xi', yi') through the sampling of the rotational acceleration value.

For example, the processor 190 may identify the values of M' and N' in [Equation 5] using the least squares method. The processor 190 may identify the values of M and N by applying the least squares method to [Equation 5] to which (z1', y1), (z2', x2', y2'), (z3', x3', y3') . . . (zi', xi', yi') is given.

In addition, the processor 190 may identify the values of M' and N' in [Equation 5] using the regressive least squares method. Thereafter, the processor 190 may identify the amplitude A of the rotational acceleration using [Equation 7].

$$A=\sqrt{M'^2+N'^2}. \quad \text{[Equation 7]}$$

Where A represents the amplitude of the rotational acceleration, M' represents the product of the amplitude of the rotational acceleration and cos α, and N' represents the product of the amplitude of the rotational acceleration and sin α.

As mentioned above, the processor 190 may identify the amplitude of the driving current and the amplitude of the rotational acceleration by using the least-squares method or the regressive least-squares method, based on the sampled driving current value and the sampled rotational acceleration value.

The processor 190 may identify the moment of inertia of the drum 130 and the laundry based on a ratio of the amplitude of the driving current to the amplitude of the rotational acceleration. For example, the processor 190 may identify the moment of inertia using [Equation 8].

$$J = \frac{K_t I}{A}. \quad \text{[Equation 8]}$$

Where J represents the moment of inertia, Kt represents the motor torque constant, I represents the amplitude of the driving current, and A represents the amplitude of the rotational acceleration.

The processor 190 may identify the magnitude of the load (the weight of the laundry accommodated in the drum) based on the moment of inertia of the drum 130 and the laundry.

In addition, in response to a sinusoidal current, which has a predetermined amplitude, being added to the driving current, the processor 190 may identify the moment of inertia of the drum 130 and the laundry based on the amplitude of the rotational acceleration.

For example, because the motor torque constant Kt in [Equation 8] is a known constant, the calculated value of the right side of [Equation 8] may be proportional to the moment of inertia J.

Accordingly, the processor 190 may calculate the moment of inertia J from the amplitude A of the rotational acceleration. In addition, the processor 190 may store a lookup table including a plurality of calculated values of the right side of [Equation 8] and a plurality of moments of inertia J corresponding thereto, and using the lookup table, may identify the moment of inertia J from the amplitude I of the driving current and the amplitude A of the rotational acceleration.

As described above, the washer 100 may supply the driving current including the sinusoidal current to the motor 140 and identify the magnitude of the load based on the rotational acceleration of the rotor 143.

The washer 100 may identify the magnitude of the load while minimizing the change in the rotational speed of the motor 140. Accordingly, the washer 100 may identify the magnitude of the load not only in the low-speed section but also in the high-speed section.

Figure 13:
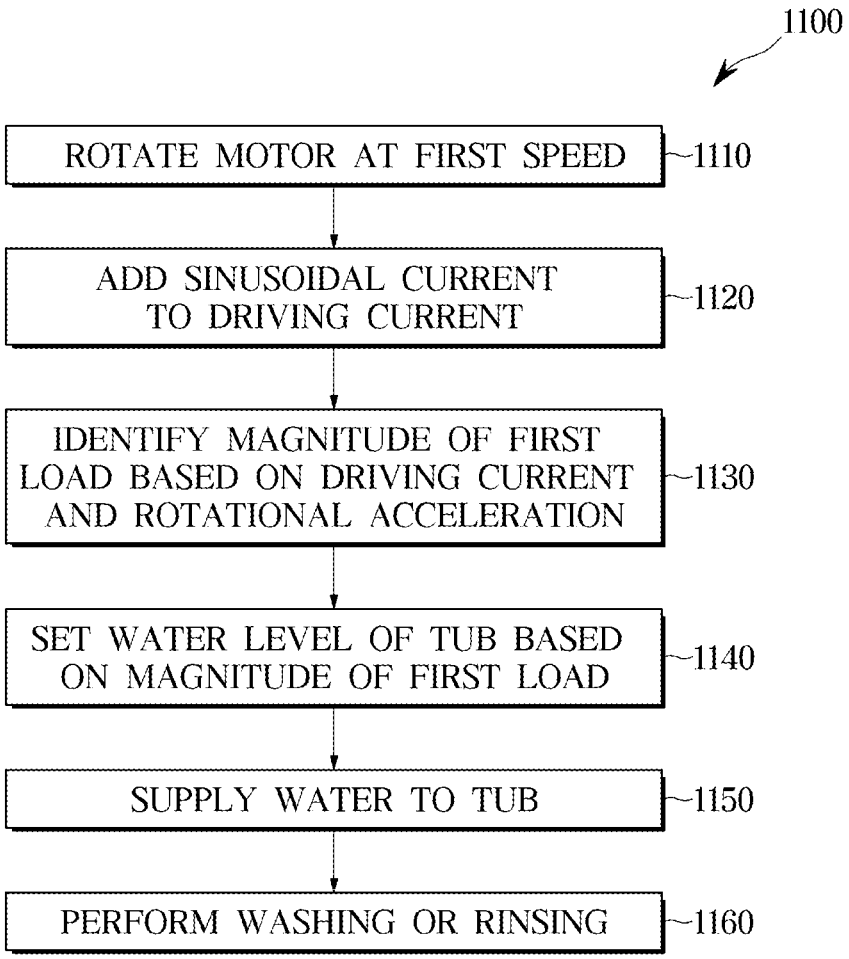
FIG. 13 illustrates a method for the washer according to an embodiment of the disclosure to set a water level for washing and rinsing.

FIG. 13 illustrates a method for the washer according to an embodiment of the disclosure to set a water level for washing and rinsing.

A method 1100 of setting a washing/rinsing water level of the washer 100 will be described with reference to FIG. 13.

The washer 100 may rotate the motor 140 at the first speed (1110).

The processor 190 may provide a target speed command to the motor drive 200 to rotate the motor 140 at the first speed in response to a user input for starting the operation of the washer 100. For example, the processor 190 may provide the motor drive 200 with the target speed command, which is to increase stepwise or linearly or gradually, to allow the motor 140 to be accelerated to the first speed. The first speed may be a rotational speed of the drum 130 for measuring the dry load (the weight of the laundry that does not absorb water for washing) accommodated in the drum 130. For example, the first speed may be less than a rotational speed corresponding to the resonant frequency of the tub 120 in order to prevent or suppress vibration and noise of the tub 120.

Resonance is a phenomenon in which the vibration of the tub 120 is greatly increased by the rotation of the drum 130, and the vibration of the tub 120 may be amplified at a specific rotational speed of the drum 130. The resonance may include a first resonance generated in a first resonance section and a second resonance generated in a second resonance section. In the first resonance, the entire tub 120 may vibrate left and right, and in the second resonance, the upper (front) and lower (rear) portions of the tub 120 may vibrate in opposite directions.

The washer 100 may add a sinusoidal current to the driving current supplied to the motor 140 (1120).

Operation 1120 may be the same as operation 1030 illustrated in FIG. 7. For example, the processor 190 may control the motor drive 200 to allow a sinusoidal waveform to be superimposed on the driving current supplied to the motor 140.

The washer 100 may identify the magnitude of the first load based on the driving current and the rotational acceleration (1130).

Operation 1130 may be the same as operation 1040 and operation 1050 illustrated in FIG. 7. For example, the motor drive 200 may provide the driving current value and the rotational speed value of the rotor 143 to the processor 190 for each sampling period. The processor 190 may identify a rotational acceleration value of the rotor 143 based on a differential value of the value of the rotational speed of the rotor 143. Further, the processor 190 may identify the magnitude of the dry load accommodated in the drum 130 based on the driving current value and the rotational acceleration value obtained for each sampling period.

Further, in response to the sinusoidal current, which has a predetermined amplitude, being added to the driving current, the processor 190 may identify the magnitude of the dry load accommodated in the drum 130 based on the rotational acceleration value obtained for each sampling period.

The washer 100 may set the water level of the tub 120 based on the magnitude of the first load (the weight of the dry load) (1140), and supply water to the tub 120 based on the set water level (1150).

The processor 190 may store a lookup table including the magnitude of the dry load and the water level of the tub 120 corresponding the magnitude of the dry load. The processor 190 may identify the set level of the tub 120 corresponding to the measured magnitude of the first load using the lookup table.

Further, the processor 190 may store a lookup table including the amplitude of the rotational acceleration of the motor 140 and the water level of the tub 120 corresponding the amplitude of the rotational acceleration. The processor 190 may identify the set level of the tub 120 corresponding to the measured amplitude of the rotational acceleration using the lookup table.

The processor 190 may control the water supplier 150 to supply water to the tub 120. The processor 190 may identify the water level of the tub 120 based on the output of the water level sensor 170 during water is supplied to the tub 120. The processor 190 may stop supplying water to the tub 120 in response to the water level of the tub 120 being greater than or equal to the set water level.

The washer 100 may perform washing or rinsing (1160).

After supplying water to the tub 120 up to the set water level, the processor 190 may control the motor drive 200 to perform the washing or rinsing. For example, the processor 190 may control the motor drive 200 to allow the motor 140 to rotate the drum 130 or the pulsator 133 at the rotational speed for the washing/rinsing.

As described above, the washer 100 may measure the dry load by supplying a sinusoidal current to the motor 140 before starting an operation for washing laundry.

Accordingly, the washer 100 may measure the dry load without the rotational speed of the drum 130 entering a resonance region of the tub 120.

Figure 14:
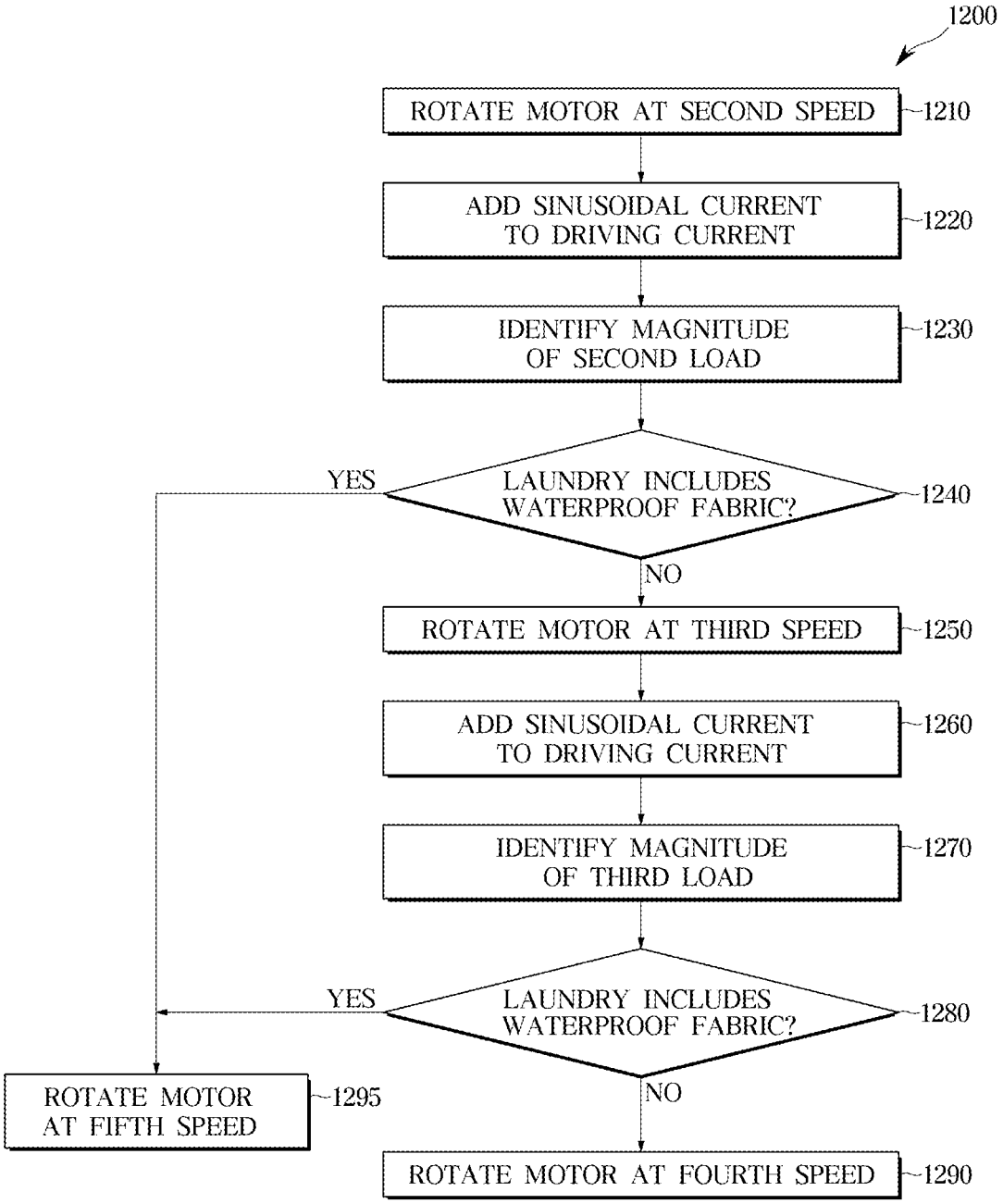
FIG. 14 illustrates a method of identifying whether a waterproof fabric is included in a load of the washer according to an embodiment of the disclosure.
Figure 15:
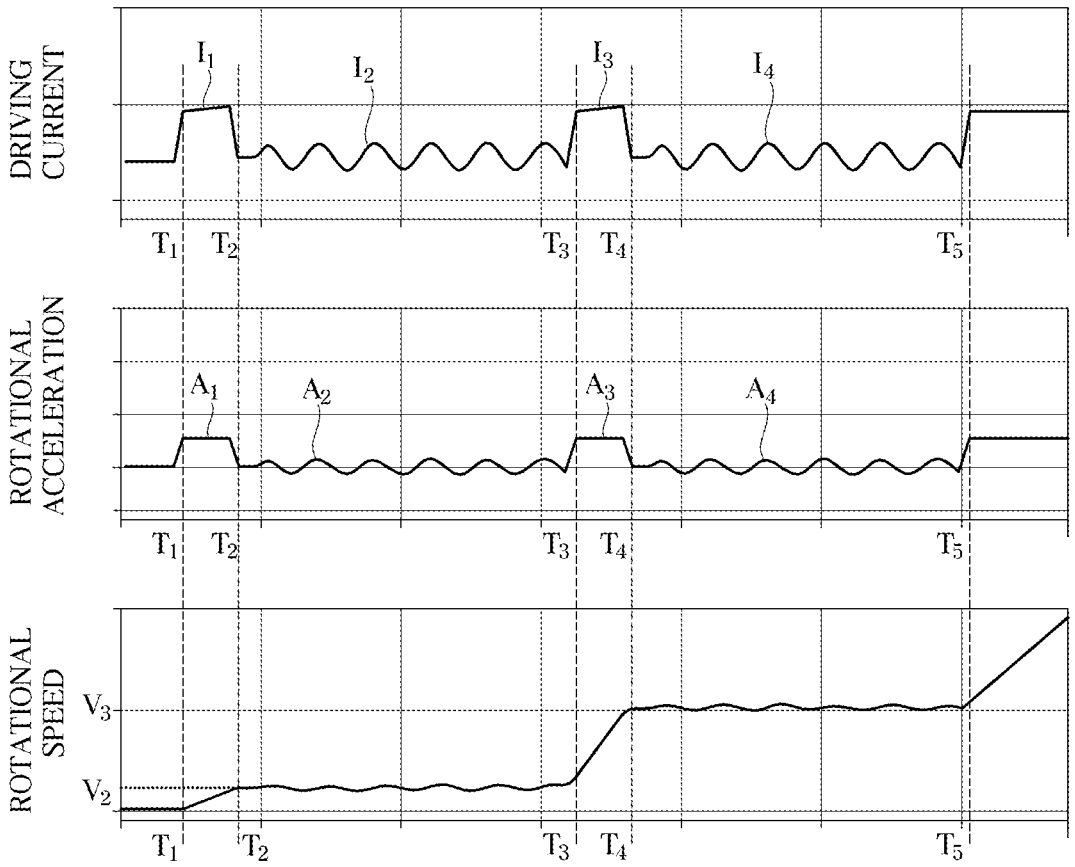
FIG. 15 illustrates a rotational speed, a rotational acceleration and a driving current by the method illustrated in FIG. 14.

FIG. 14 illustrates a method of identifying whether a waterproof fabric is included in a load of the washer according to an embodiment of the disclosure. FIG. 15 illustrates a rotational speed, a rotational acceleration and a driving current by the method illustrated in FIG. 14.

A method 1200 of identifying whether or not a waterproof fabric is included in the laundry contained in the drum 130 is described with reference to FIGS. 14 and 15.

The washer 100 may rotate the motor 140 at a second speed (1210).

As described with reference to FIG. 13, the processor 190 may supply water to the tub 120 to perform the washing or rinsing. The processor 190 may control the drain 160 to discharge the water contained in the tub 120 to the outside based on the completion of washing or rinsing.

The processor 190 may control the motor drive 200 to rotate the drum 130 at the second speed in response to the water level of the tub 120 being less than or equal to the reference water level (e.g., "0") during drainage. For example, the processor 190 may provide the motor drive 200 with a target speed command, which is to increase stepwise or linearly or gradually, to allow the motor 140 to be accelerated to the second speed. The second speed may be a rotational speed of the drum 130 for measuring a wet load (weight of laundry absorbing water for washing) accommodated in the drum 130. For example, in order to prevent or suppress the vibration and noise of the tub 120, the second speed may be less than or greater than the rotational speed corresponding to the first resonance section of the tub 120.

As illustrated in FIG. 15, the processor 190 may control the motor drive 200 to allow the rotational speed of the motor 140 to reach the second speed V2 between time T1 and time T2. The motor drive 200 may provide the motor 140 with a first driving current I1 for increasing the rotational speed of the motor 140 between time T1 and time T2. In response to the first driving current I1, the rotational acceleration of the motor 140 may increase to a first acceleration A1 between time T1 and time T2.

The washer 100 may add a sinusoidal current to the driving current supplied to the motor 140 (1220).

Operation 1220 may be the same as operation 1030 illustrated in FIG. 7. For example, the processor 190 may control the motor drive 200 to allow a sinusoidal waveform to be superimposed on the driving current supplied to the motor 140.

As illustrated in FIG. 15, the processor 190 may provide a target speed command including a sinusoidal waveform or a load measurement command for load measurement to the motor drive 200 between time T2 and time T3. The motor drive 200 may supply the second driving current I2 including a sinusoidal current to the motor 140 between time T2 and time T3. In response to the second driving current I2, the rotational acceleration of the motor 140 may be a second acceleration A2 in the form of a sinusoidal wave between time T2 and time T3.

The washer 100 may identify the magnitude of the second load based on the driving current and the rotational acceleration (1230).

Operation 1230 may be the same as operation 1040 and operation 1050 illustrated in FIG. 7. For example, the processor 190 may identify the magnitude of the second load (wet load) accommodated in the drum 130 based on the driving current value and the rotational acceleration value obtained for each sampling period.

In addition, in response to a sinusoidal current, which has a predetermined amplitude, being added to the driving current, the processor 190 may identify the magnitude of the second load (wet load) accommodated in the drum 130 based on the rotational acceleration value obtained for each sampling period.

The second load (wet load) may indicate the weight of the laundry absorbing water for washing or rinsing. Accordingly, the second load may be greater than the first load (dry load) indicating the weight of the laundry that does not absorb water.

The washer 100 may identify whether the waterproof fabric is included in the laundry based on the magnitude of the second load (1240).

The processor 190 may identify whether or not the waterproof fabric is included in the laundry based on the comparison between the dry load (first load) and the wet load (second load).

In response to the laundry not including the waterproof fabric, a ratio of the second load to the first load may be within a predetermined range. Conventional fabrics (including clothing and bedding) may not absorb water indefinitely, and absorb water according to a specific range of absorption rates. In other words, the ratio of the weight of the wet fabric to the weight of the dry fabric may be less than a predetermined value (e.g., a maximum absorption of the conventional fabric).

On the other hand, in response to the laundry including the waterproof fabric, the ratio of the second load to the first load may be out of a predetermined range. The waterproof fabric may trap water that is supplied during the washing or rinsing. Accordingly, the ratio of the weight of the water-entrained waterproof fabric to the weight of the dry waterproof fabric may be greater than a predetermined value (e.g., the maximum absorption of the conventional fabric).

Accordingly, the processor 190 may identify whether the waterproof fabric is included in the laundry based on a ratio of the magnitude of the second load to the magnitude of the first load.

For example, the processor 190 may identify whether or not the waterproof fabric is included in the laundry based on [Equation 9].

$$J_2 > R_1 J_1 + J_0 \quad \text{[Equation 9]}$$

Where J2 represents the second load (wet load), J1 represents the first load (dry load), R1 represents the maximum absorption of the conventional fabric, and J0 represents a constant.

The processor 190 may identify that the waterproof fabric is included in the laundry based on the fact that the inequality of [Equation 9] is satisfied. For example, the processor 190 may identify that the laundry includes the waterproof fabric based on the ratio of the second load to the first load being greater than the maximum absorption of the conventional fabric.

Further, the processor 190 may identify that the waterproof fabric is not included in the laundry, based on the fact that the inequality of [Equation 9] is not satisfied. For example, the processor 190 may identify that the waterproof fabric is not included in the laundry based on the ratio of the second load to the first load being less than or equal to the maximum absorption of the conventional fabric.

In addition, in response to a sinusoidal current, which has a predetermined amplitude, being added to the driving current, the processor 190 may identify whether the waterproof fabric is not included in the laundry based on the rotational acceleration caused by the dry load and the rotational acceleration of the wet load.

For example, the processor 190 may identify that the waterproof fabric is included in the laundry based on a ratio of the amplitude of the rotational acceleration of the dry load to the amplitude of the rotational acceleration of the wet load being greater than the maximum absorption of the conventional fabric. In addition, the processor 190 may identify that the waterproof fabric is not included in the laundry based on the ratio of the amplitude of the rotational acceleration of the dry load to the amplitude of the rotational acceleration of the wet load being equal to or less than the maximum absorption of the conventional fabric.

In response to determining that the laundry does not include the waterproof fabric (no in 1240), the washer 100 may rotate the motor at a third speed (1250).

The processor 190 may control the motor drive 200 to rotate the drum 130 at the third speed based on determining that the laundry does not include the waterproof fabric. The third speed may be greater than the second speed, and may be a rotational speed of the drum 130 for measuring the wet load accommodated in the drum 130. For example, the third speed may be a rotational speed between the first resonance section and the second resonance section of the tub 120 or may be greater than the rotational speed corresponding to the second resonance section.

As illustrated in FIG. 15, the processor 190 may control the motor drive 200 to allow the rotational speed of the motor 140 to reach the third speed V3 between time T3 and time T4. The motor drive 200 may provide the motor 140 with a third driving current I3 for increasing the rotational speed of the motor 140 between time T3 and time T4. In response to the third driving current I3, the rotational acceleration of the motor 140 may increase to a third acceleration A3 between time T3 and time T4.

The washer 100 may add a sinusoidal current to the driving current supplied to the motor 140 (1260).

Operation 1260 may be the same as operation 1030 illustrated in FIG. 7. For example, the processor 190 may control the motor drive 200 to allow a sinusoidal waveform to be superimposed on the driving current supplied to the motor 140.

As illustrated in FIG. 15, the processor 190 may provide a target speed command including a sinusoidal waveform or a load measurement command for load measurement to the motor drive 200 between time T4 and time T5. The motor drive 200 may supply a fourth driving current I4 including a sinusoidal current to the motor 140 between time T4 and time T5. In response to the fourth driving current I4, the rotational acceleration of the motor 140 may be a fourth acceleration A4 in the form of a sinusoidal wave between time T4 and time T5.

The washer 100 may identify the magnitude of the third load based on the driving current and the rotational acceleration (1270).

Operation 1270 may be the same as operation 1040 and operation 1050 illustrated in FIG. 7. For example, the processor 190 may identify the magnitude of the third load (wet load) accommodated in the drum 130 based on the driving current value and the rotational acceleration value obtained for each sampling period.

In addition, in response to a sinusoidal current, which has a predetermined amplitude, being added to the driving current, the processor 190 may identify the magnitude of the third load (wet load) accommodated in the drum 130 based on the rotational acceleration value obtained for each sampling period.

The third load (wet load) may indicate the weight of laundry measured during the drum 130 is rotated at the third speed V3. Due to the rotation of the drum 130, some of the water may be separated from the laundry. Accordingly, the third load may be less than the second load measured during the drum 130 is rotated at the second speed V2 which is less than the third speed V3.

The washer 100 may identify whether the waterproof fabric is included in the laundry based on the size of the third load (1280).

The processor 190 may identify whether or not the waterproof fabric is included in the laundry based on the comparison between the dry load (first load) and the wet load (third load).

Operation 1280 may be similar to operation 1240.

For example, the processor 190 may identify that the laundry includes the waterproof fabric based on the ratio of the third load to the first load being greater than the maximum absorption of the conventional fabric. Further, the processor 190 may identify that the waterproof fabric is not included in the laundry based on the ratio of the second load to the first load being less than or equal to the maximum absorption of the conventional fabric.

In addition, in response to a sinusoidal current, which has a predetermined amplitude, being added to the driving current, the processor 190 may identify that the laundry does not include a waterproof fabric based on the rotational acceleration of the dry load and the rotational acceleration of the wet load.

In response to determining that the laundry does not include the waterproof fabric (no in 1280), the washer 100 may rotate the motor at the fourth speed (1290).

The processor 190 may control the motor drive 200 to rotate the drum 130 at a fourth speed based on determining that the laundry does not include the waterproof fabric.

The fourth speed may represent a rotational speed of the drum 130 for spin-drying laundry not including a waterproof fabric. For example, the fourth speed may be approximately 1000 rpm or more.

In response to determining that the laundry includes the waterproof fabric (yes in 1240 or yes in 1280), the washer 100 may rotate the motor at the fourth speed (1295).

The processor 190 may control the motor drive 200 to rotate the drum 130 at a fifth speed based on determining that the laundry includes the waterproof fabric.

The fifth speed may represent a rotational speed of the drum 130 for spin-drying laundry including the waterproof fabric, and may be less than the fourth speed. For example, the fourth speed may be approximately 500 rpm.

As described above, the washer 100 may identify the magnitude of the wet load while rotating the drum 130 for the spin-drying. Further, the washer 100 may identify whether the laundry includes the waterproof fabric based on the comparison between the dry load and the wet load.

Accordingly, the washer 100 may prevent or suppress the vibration of the drum 130 due to the unbalance of the load by the waterproof fabric.

Figure 16:
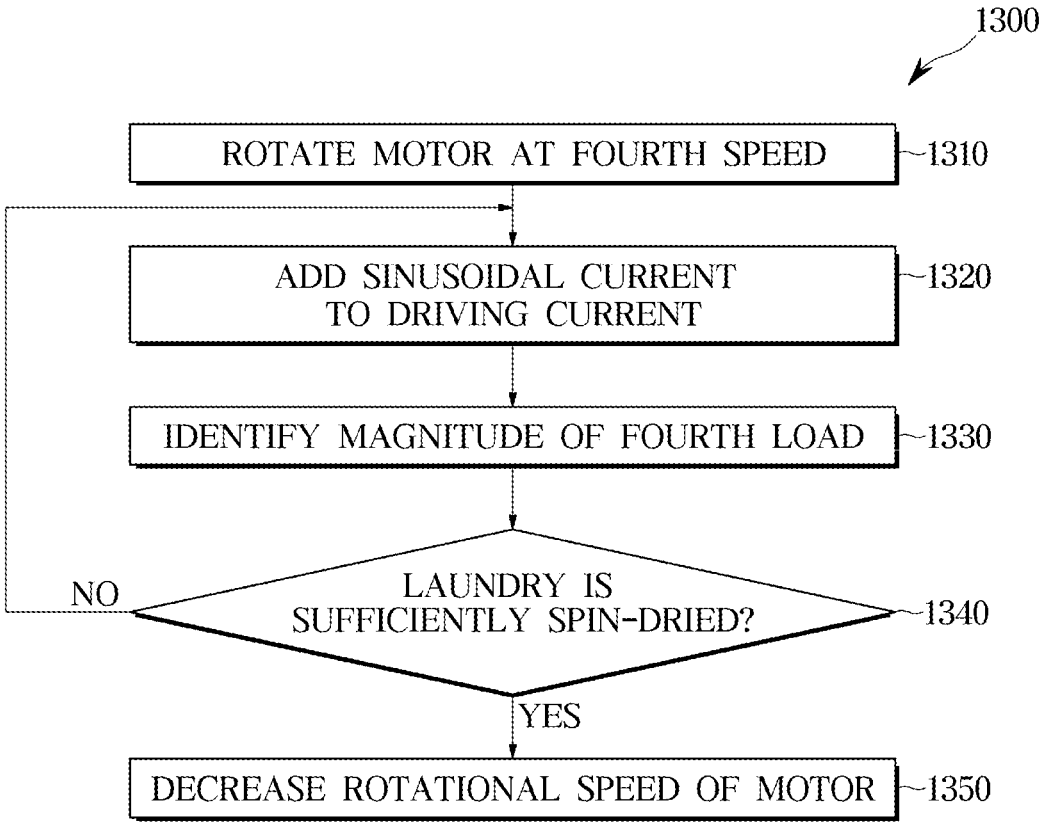
FIG. 16 illustrates a method of identifying a moisture content of laundry during spin drying of the washer according to an embodiment of the disclosure.
Figure 17:
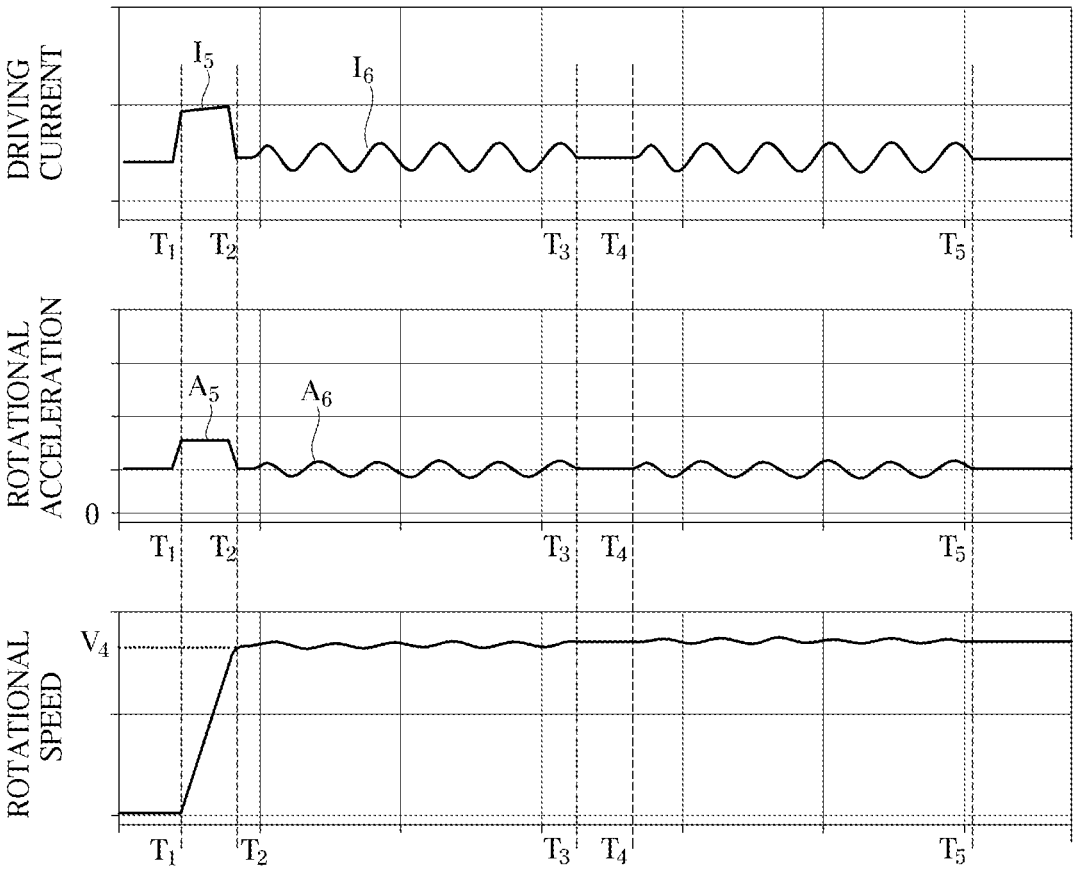
FIG. 17 illustrates a rotational speed, a rotational acceleration and a driving current by the method illustrated in FIG. 16.

FIG. 16 illustrates a method of identifying a moisture content of laundry during spin drying of the washer according to an embodiment of the disclosure. FIG. 17 illustrates a rotational speed, a rotational acceleration and a driving current by the method illustrated in FIG. 16.

A method 1300 of identifying the moisture content of laundry accommodated in the drum 130 is described with reference to FIGS. 16 and 17.

The washer 100 may rotate the motor 140 at a fourth speed (or fifth speed) (1310).

The processor 190 may control the motor drive 200 to rotate the drum 130 at the fourth speed (or fifth speed) during the spin-drying. The fourth speed (or fifth speed) may represent a final rotational speed (maximum rotational speed) for separating water from laundry. For example, in response to the laundry not including the waterproof fabric, the processor 190 may rotate the motor 140 at 1000 rpm or more. In addition, in response to the laundry including the waterproof fabric, the processor 190 may rotate the motor 140 at approximately 500 rpm.

As illustrated in FIG. 17, the processor 190 may control the motor drive 200 to allow the rotational speed of the motor 140 to reach the fourth speed V4 between time T1 and time T2. The motor drive 200 may provide the motor 140 with a fifth driving current I5 for increasing the rotational speed of the motor 140 between time T1 and time T2. In response to the fifth driving current I5, the rotational acceleration of the motor 140 may increase to a fifth acceleration A5 between time T1 and time T2.

The washer 100 may add a sinusoidal current to the driving current supplied to the motor 140 (1320).

Operation 1320 may be the same as operation 1030 illustrated in FIG. 7.

For example, the processor 190 may control the motor drive 200 to allow a sinusoidal waveform to be superimposed on the driving current supplied to the motor 140.

As illustrated in FIG. 17, the processor 190 may provide a target speed command including a sinusoidal waveform or a load measurement command for load measurement to the motor drive 200 between time T2 and time T3. The motor drive 200 may supply a sixth driving current I6 including a sinusoidal current to the motor 140 between time T2 and time T3. In response to the sixth driving current I6, the rotational acceleration of the motor 140 may be a sixth acceleration A6 in the form of a sinusoidal wave between the time T2 and the time T3.

The washer 100 may identify the magnitude of the fourth load based on the driving current and the rotational acceleration (1330).

Operation 1330 may be the same as operation 1040 and operation 1050 illustrated in FIG. 7. For example, the processor 190 may identify the magnitude of the fourth load, which is spin-dried, based on the driving current value and the rotational acceleration value obtained for each sampling period.

Further, in response to a sinusoidal current, which has a predetermined amplitude, being added to the driving current, the processor 190 may identify the magnitude of the fourth load based on the rotational acceleration value obtained for each sampling period.

The fourth load may represent the weight of the laundry from which water is separated by the drum 130 that is rotated at high speed. Accordingly, the fourth load may be greater than the first load indicating the weight of the laundry that does not absorb water, and may be less than the second or third load indicating the weight of the laundry before spin-drying.

The washer 100 may identify whether the laundry is sufficiently spin-dried based on the magnitude of the fourth load (1340).

The processor 190 may identify whether the laundry is sufficiently spin-dried based on the comparison between the first load and the fourth load.

As the spin-drying of laundry proceeds, the magnitude of the fourth load may decrease. In addition, as the spin-drying of the laundry proceeds, a ratio of the magnitude of the fourth load to the magnitude of the first load may decrease.

Accordingly, the processor 190 may identify the degree of spin-drying of laundry based on a ratio of the magnitude of the fourth load to the magnitude of the first load.

For example, the processor 190 may identify whether the laundry is sufficiently spin-dried based on [Equation 10].

$$J_4 < R_2 J_1 + J_0. \quad \text{[Equation 10]}$$

Where J4 represents the fourth load, J1 represents the first load (dry load), R2 represents the reference moisture content for terminating the spin-drying, and J0 represents a constant.

The processor 190 may identify that the laundry is sufficiently spin-dried based on a fact that the inequality of [Equation 10] is satisfied. In other words, the processor 190 may identify that the laundry is sufficiently spin-dried, based on the weight ratio of water included in the spin-dried load being less than the reference moisture content.

In addition, the processor 190 may identify that additional spin-drying of laundry is required based on the fact that the inequality of [Equation 10] is not satisfied. In other words, the processor 190 may identify that the laundry is not sufficiently spin-dried based on the fact that the weight ratio of water included in the spin-dried load is greater than the reference moisture content.

In addition, in response to a sinusoidal current, which has a predetermined amplitude, being added to the driving current, the processor 190 may identify whether the laundry is sufficiently spin-dried based on the rotational acceleration of the dry load and the rotational acceleration of the wet load.

In response to identifying that the laundry is not sufficiently spin-dried (no in 1340), the washer 100 may repeat to identify the fourth load and identify whether the laundry is sufficiently spin-dried.

In response to identifying that the laundry is sufficiently spin-dried (yes in 1340), the washer 100 may decrease the rotational speed of the motor 140 (1350).

The processor 190 may identify that the laundry is sufficiently spin-dried based on the weight ratio of water included in the spin-dried load being less than the reference moisture content. Accordingly, the processor 190 may terminate the spin-drying. Accordingly, power consumption caused by the spin-drying may be reduced.

As described above, the washer 100 may identify the magnitude of the load during the spin-drying. Further, the washer 100 may identify whether the laundry is sufficiently spin-dried based on the magnitude of the load identified during the spin-drying.

Accordingly, the washer 100 may prematurely terminate the spin-drying according to the degree to which the laundry is spin-dried, thereby reducing power consumption caused by the spin-drying.

Figure 18:
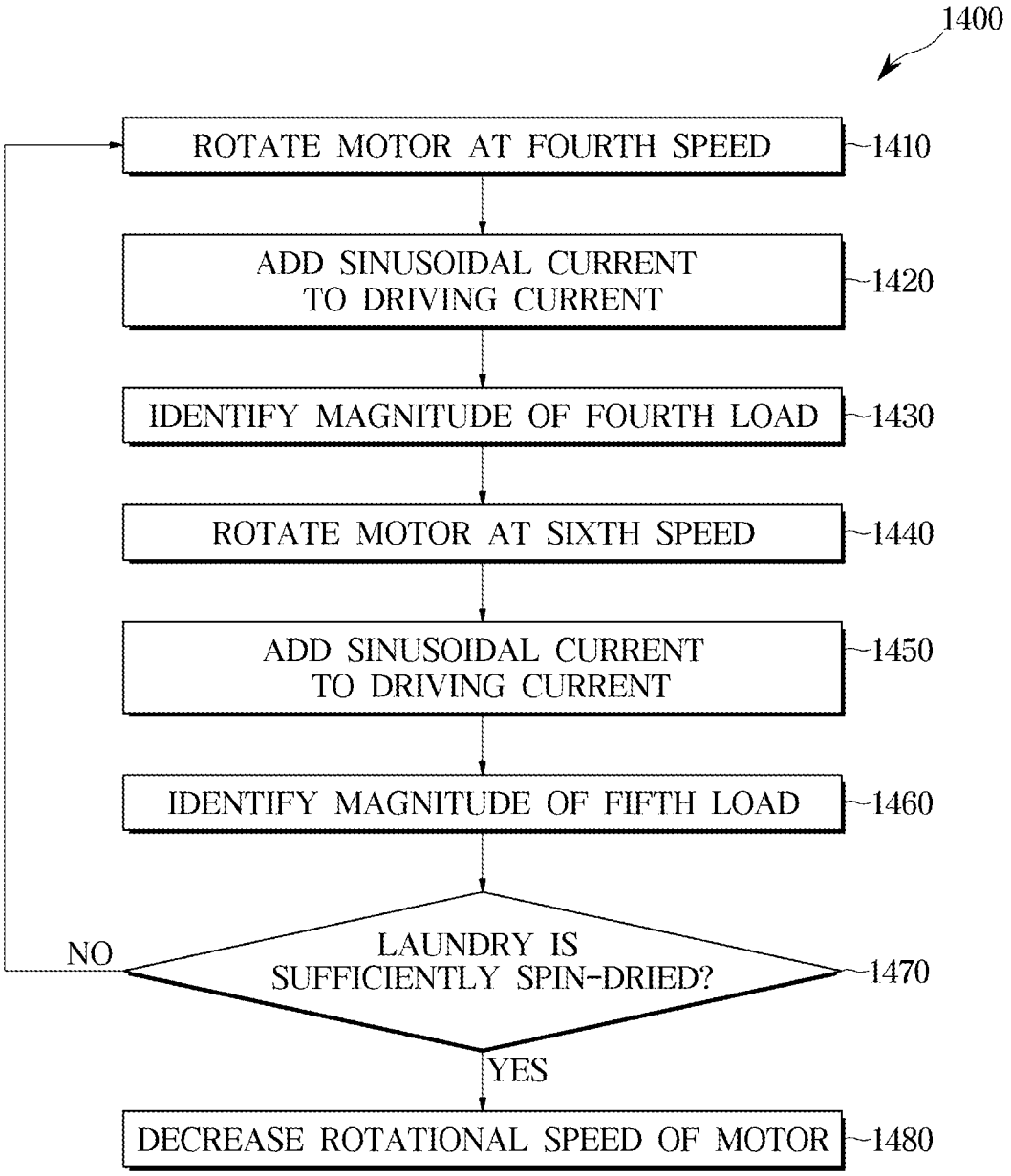
FIG. 18 illustrates a method of identifying a moisture content of laundry during the spin drying of the washer according to an embodiment of the disclosure.

FIG. 18 illustrates a method of identifying a moisture content of laundry during spin drying of the washer according to an embodiment of the disclosure.

A method 1400 of identifying the moisture content of laundry contained in the drum 130 is described with reference to FIG. 18.

The washer 100 may rotate the motor 140 at a fourth speed (1410). The washer 100 may add a sinusoidal current to the driving current supplied to the motor 140 (1420). The washer 100 may identify the magnitude of the fourth load based on the driving current and the rotational acceleration (1430).

Operations 1410, 1420, and 1430 may be the same as operations 1310, 1320, and 1330 illustrated in FIG. 16, respectively.

The washer 100 may rotate the motor 140 at a sixth speed (1440). The washer 100 may add a sinusoidal current to the driving current supplied to the motor 140 (1450). The washer 100 may identify a magnitude of a fifth load based on the driving current and the rotational acceleration (1460).

The sixth speed may be different from or the same as the fourth speed.

Operations 1440, 1450, and 1460 may be the same as operations 1310, 1320, and 1330 illustrated in FIG. 16, respectively.

The washer 100 may identify whether the laundry is sufficiently spin-dried based on the magnitude of the fourth load and the magnitude of the fifth load (1470).

The processor 190 may identify whether the laundry is sufficiently spin-dried based on the comparison between the fourth load and the fifth load.

As the spin-drying of laundry progresses, the magnitude of the wet load may be reduced. In other words, the magnitude of the fifth load may be less than the magnitude of the fourth load.

At this time, the small difference between the magnitude of the fourth load and the magnitude of the fifth load may indicate that the spin-drying due to the rotation of the drum 130 is saturated. Accordingly, in response to the difference between the magnitude of the fourth load and the magnitude of the fifth load being small, the processor 190 may identify whether the laundry is sufficiently spin-dried.

For example, the processor 190 may identify whether the laundry is sufficiently spin-dried in response to the ratio of the difference between the magnitude of the fourth load and the magnitude of the fifth load to the magnitude of the fourth load being less than a reference value.

In response to identifying that the laundry is not sufficiently spin-dried (no in 1470), the washer 100 may repeat to identify the fourth load and the fifth load and identify whether the laundry is sufficiently spin-dried.

In response to identifying that the laundry is sufficiently spin-dried (yes in 1470), the washer 100 may reduce the rotational speed of the motor 140 (1480).

The processor 190 may terminate the spin-drying.

As described above, the washer 100 may identify the magnitude of the load during the spin-drying. Further, the washer 100 may identify whether the laundry is sufficiently spin-dried based on the magnitude of the load identified during the spin-drying.

Accordingly, the washer 100 may prematurely terminate the spin-drying according to the degree to which the laundry is spin-dried, thereby reducing power consumption caused by the spin-drying.

A washer according to an embodiment may include a drum, a motor connected to the drum through a rotating shaft, a motor drive operatively connected to the motor, and a processor operatively connected to the motor drive. The processor may be configured to rotate the motor at a target speed and to determine a magnitude of a load accommodated in the drum while changing a rotational speed of the motor within a predetermined range.

The processor may be configured to periodically change the rotational speed of the motor within 5% of the target speed.

The processor may be configured to periodically change within 0.5% of the rotational speed of the motor during spin-drying.

Accordingly, the washer may identify the magnitude of the load in the high speed section as well as the low speed section because the change in the rotational speed of the motor is minimized while determining the magnitude of the load.

The processor may be configured to control the motor drive to supply a driving current including a sinusoidal current to the motor, and to determine the magnitude of the load accommodated in the drum based on a change in the rotational speed of the motor caused by the driving current including the sinusoidal current.

The processor may further be configured to provide a target speed signal including a sinusoidal waveform to the motor drive so as to supply a driving current including a sinusoidal current to the motor.

Accordingly, without adding a component for measuring the magnitude of the load in the high-speed section, the washer may identify the magnitude of the load even in the high-speed section by the periodic change of the driving current.

The processor may further be configured to control the motor drive to supply a first drive current including the sinusoidal current to the motor before supplying water to the drum, and to adjust an amount of water supplied to the drum based on a value of a first rotational speed of the motor caused by the first driving current.

Accordingly, the washer may measure the magnitude of the dry load at an approximately predetermined speed without generating noise and vibration due to the operation for measuring the magnitude of the dry load.

The processor may be configured to control the motor drive to supply a second drive current including the sinusoidal current to the motor after supplying water to the drum, to control the motor drive to control the rotational speed of the motor based on a value of a second rotational speed of the motor caused by the second drive current, and to determine a magnitude of a load accommodated in the drum based on a ratio of the value of the first rotational speed to the value of the second rotational speed.

The processor may further be configured to identify a magnitude of a dry load accommodated in the drum based on a change in the first rotational speed of the motor, and to identify a magnitude of a wet load accommodated in the drum based on a change in the second rotational speed of the motor.

Accordingly, the washer may identify whether or not the waterproof laundry is accommodated in the drum, based on the comparison of the magnitude of the dry load and the magnitude of the wet load.

The processor may control the motor drive to control the rotational speed of the motor based on a ratio of the magnitude of the wet load to the magnitude of the dry load.

The processor may be configured to control the motor drive to rotate the motor at a first speed based on the ratio of the magnitude of the wet load to the magnitude of the dry load being less than a first reference value, and to control the motor drive to rotate the motor at a second speed, which is less than the first speed, based on the ratio of the magnitude of the wet load to the magnitude of the dry load being equal to or greater than the first reference value.

Accordingly, the washer may reduce vibration and noise caused by the waterproof laundry by controlling the rotational speed of the drum during the spin-drying.

The processor may further be configured to control the motor drive to supply a third drive current including the sinusoidal current to the motor during rotating the motor at a third speed for spin-drying, and to identify a magnitude of spin-dried load of the drum based on a value of a third rotational speed of the motor including a sinusoidal waveform caused by the third driving current.

The processor may further be configured to control the motor drive to control the rotational speed of the motor based on the magnitude of the spin-dried load.

The processor may further be configured to control the motor drive to reduce the rotational speed of the motor based on a ratio of the magnitude of the spin-dried to the magnitude of the dry load being less than a second reference value, and to control the motor drive to maintain the rotational speed of the motor based on the ratio of the magnitude of the spin-dried to the magnitude of the dry load being equal to or greater than the second reference value.

Accordingly, the washer may identify whether spin-drying is completed while minimizing the change in the rotational speed of the drum during spin-drying at the minimum speed.

As is apparent from the above description, a washer and a control method thereof may measure a load accommodated in a drum while minimizing a change in a rotational speed of the drum. Accordingly, the washer may accurately measure the load.

Further, a washer and a control method thereof may measure a load accommodated in a drum even during high-speed rotation. Accordingly, the washer may measure the load and a change in the load during a spin-drying cycle Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which can be decoded by a computer are stored. For example, there may be a Read Only Memory (ROM), a Random Access Memory (RAM), a magnetic tape, a magnetic disk, a flash memory, and an optical data storage device.

Storage medium readable by machine, may be provided in the form of a non-transitory storage medium. "Non-transitory" means that the storage medium is a tangible device and does not contain a signal (e.g., electromagnetic wave), and this term includes a case in which data is semi-permanently stored in a storage medium and a case in which data is temporarily stored in a storage medium.

The method according to the various disclosed embodiments may be provided by being included in a computer program product. Computer program products may be traded between sellers and buyers as commodities. Computer program products are distributed in the form of a device-readable storage medium (e.g., compact disc read only memory (CD-ROM)), or are distributed directly or online (e.g., downloaded or uploaded) between two user devices (e.g., smartphones) through an application store (e.g., Play Store™). In the case of online distribution, at least a portion of the computer program product (e.g., downloadable app) may be temporarily stored or created temporarily in a device-readable storage medium such as the manufacturer's server, the application store's server, or the relay server's memory.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A washer comprising:

a drum;

a motor connected to the drum;

a motor drive connected to the motor and configured to supply a driving current to the motor to rotate the drum; and a processor connected to the motor drive, and configured to:

control the motor drive to supply the driving current to the motor to rotate the motor at a target speed; and determine a magnitude of a load accommodated in the drum while controlling a rotational speed of the motor within a predetermined range.

2. The washer of claim 1, wherein the processor is further configured to periodically control the rotational speed of the motor within 5% of the target speed.

3. The washer of claim 1, wherein the processor is further configured to periodically control within 0.5% of the rotational speed of the motor during spin-drying.

4. The washer of claim 1, wherein the processor is further configured to:

control the motor drive to supply the driving current comprising a sinusoidal current to the motor, and determine the magnitude of the load accommodated in the drum based on a change in the rotational speed of the motor caused by the driving current comprising the sinusoidal current.

5. The washer of claim 4, wherein the processor is further configured to provide a target speed signal comprising a sinusoidal waveform to the motor drive so as to supply the driving current comprising the sinusoidal current to the motor.

6. The washer of claim 4, wherein the processor is further configured to control the motor drive to control the rotational speed of the motor based on the magnitude of the load.

7. The washer of claim 4, wherein the processor is further configured to:

control the motor drive to supply a first driving current comprising the sinusoidal current to the motor before supplying water to the drum; and adjust an amount of water supplied to the drum based on a value of a first rotational speed of the motor caused by the first driving current.

8. The washer of claim 7, wherein the processor is further configured to:

control the motor drive to supply a second driving current comprising the sinusoidal current to the motor after supplying water to the drum;

control the motor drive to control the rotational speed of the motor based on a value of a second rotational speed of the motor caused by the second driving current; and determine a magnitude of a load accommodated in the drum based on a ratio of the value of the first rotational speed to the value of the second rotational speed.

9. The washer of claim 8, wherein the processor is further configured to:

identify a magnitude of a dry load accommodated in the drum based on a change in the first rotational speed of the motor; and identify a magnitude of a wet load accommodated in the drum based on a change in the second rotational speed of the motor.

10. The washer of claim 9, wherein the processor is further configured to control the motor drive to control the rotational speed of the motor based on a ratio of the magnitude of the wet load to the magnitude of the dry load.

11. The washer of claim 10, wherein the processor is further configured to:

control the motor drive to rotate the motor at a first speed based on the ratio of the magnitude of the wet load to the magnitude of the dry load being less than a first reference value; and control the motor drive to rotate the motor at a second speed, which is less than the first speed, based on the ratio of the magnitude of the wet load to the magnitude of the dry load being equal to or greater than the first reference value.

12. The washer of claim 9, wherein the processor is further configured to;

control the motor drive to supply a third driving current comprising the sinusoidal current to the motor during rotating the motor at a third speed for a spin-drying operation of the washer; and identify a magnitude of a spin-dried load of the drum based on a value of a third rotational speed of the motor comprising a sinusoidal waveform caused by the third driving current.

13. The washer of claim 12, wherein the processor is further configured to control the motor drive to control the rotational speed of the motor based on the magnitude of the spin-dried load.

14. The washer of claim 13, wherein the processor is further configured to:

control the motor drive to reduce the rotational speed of the motor based on a ratio of the magnitude of the spin-dried load to the magnitude of the dry load being less than a second reference value; and control the motor drive to maintain the rotational speed of the motor based on the ratio of the magnitude of the spin-dried load to the magnitude of the dry load being equal to or greater than the second reference value.

15. A control method of a washer comprising:

controlling, by a processor, a motor drive to supply a driving current to a motor;

rotating a drum connected to the motor at a target speed;

controlling a rotational speed of the motor within a predetermined range;

determining a magnitude of a load accommodated in the drum in response to the controlling of the rotational speed of the motor within the predetermined range; and controlling the rotational speed of the motor based on the magnitude of the load.

16. The control method of claim 15, further comprising:

controlling the motor drive to supply the driving current comprising a sinusoidal current to the motor, and determining the magnitude of the load accommodated in the drum based on a change in the rotational speed of the motor caused by the driving current comprising the sinusoidal current.

17. The control method of claim 16, wherein the controlling of the motor drive to supply the driving current further comprises transmitting a target speed signal comprising a sinusoidal waveform to the motor drive.

18. The control method of claim 16, further comprising controlling the motor drive to control the rotational speed of the motor based on the magnitude of the load.

19. The control method of claim 16, further comprising:

controlling the motor drive to supply a first driving current comprising the sinusoidal current to the motor before supplying water to the drum; and adjusting an amount of water supplied to the drum based on a value of a first rotational speed of the motor caused by the first driving current.

20. A washer comprising:

a drum;

a motor connected to the drum;

a motor drive connected to the motor and configured to supply a driving current to the motor to rotate the drum; and a processor connected to the motor drive, and configured to:

control the motor drive to supply the driving current comprising a sinusoidal current to the motor; and determine a magnitude of a load accommodated in the drum based on a change in a rotational speed of the motor caused by the driving current comprising the sinusoidal current.

* * * * *